US009157291B2

(12) United States Patent
Favilli et al.

(10) Patent No.: US 9,157,291 B2
(45) Date of Patent: Oct. 13, 2015

(54) UNDERWATER DEVICE AND METHOD FOR BLOCKING OUTFLOW OF A FLUID LIKE OIL OR GAS BY AN UNDERWATER WELL

(75) Inventors: Stefano Favilli, Rosignano Marittimo (IT); Matteo Bertolini, Rosignano Solvay (IT); Giacomo Iarrusso, Rosignano Solvay (IT)

(73) Assignee: SIME SRL, Rosignano Solvay (LI) (IT)

( * ) Notice: Subject to any disclaimer, the term of this patent is extended or adjusted under 35 U.S.C. 154(b) by 220 days.

(21) Appl. No.: 13/806,147

(22) PCT Filed: Jun. 21, 2011

(86) PCT No.: PCT/IB2011/052721

§ 371 (c)(1),
(2), (4) Date: Jun. 21, 2013

(87) PCT Pub. No.: WO2011/161625

PCT Pub. Date: Dec. 29, 2011

(65) Prior Publication Data

US 2014/0158365 A1 Jun. 12, 2014

(30) Foreign Application Priority Data

Jun. 21, 2010 (IT) ..... PI2010A0073

(51) Int. Cl.
*E21B 33/035* (2006.01)
*E21B 33/02* (2006.01)

(52) U.S. Cl.
CPC ..... *E21B 33/035* (2013.01); *E21B 33/02* (2013.01)

(58) Field of Classification Search
CPC ..... E21B 33/02; E21B 33/035; E21B 43/12; E21B 43/0122
USPC ..... 166/363, 364, 368; 169/69
See application file for complete search history.

(56) References Cited

U.S. PATENT DOCUMENTS

| | | | | | |
|---|---|---|---|---|---|
| 1,485,862 | A * | 3/1924 | Lester | 166/97.1 |
| 1,822,141 | A * | 9/1931 | Gallaher | 166/92.1 |
| 3,050,117 | A * | 8/1962 | Haeber et al. | 166/352 |
| 3,603,385 | A * | 9/1971 | Jones | 166/336 |
| 4,337,831 | A * | 7/1982 | Thaxton | 169/69 |
| 5,121,797 | A * | 6/1992 | DeCuir, Sr. | 166/386 |
| 5,158,138 | A * | 10/1992 | DeCuir, Sr. | 166/95.1 |
| 6,189,620 | B1 * | 2/2001 | McDowell | 166/379 |
| 2003/0146004 | A1 * | 8/2003 | Cicanese | 169/13 |

* cited by examiner

*Primary Examiner* — James G Sayre
(74) *Attorney, Agent, or Firm* — Ladas & Parry LLP

(57) ABSTRACT

The present invention relates to a device and to a method for blocking the outflow of a pressurized fluid from an underwater well, in particular, for blocking the outflow of crude oil and/or of natural gas, for carrying out an operation of closure of the well. In particular, the invention relates to a device and to a method for quickly stopping the flow and closing the well in case of incident and/or in case of fault of emergency shut-off devices of the underwater well, such as "blowout preventer" ("BOP") systems, in order to reduce harm to the environment and economic losses due to fluid outflow from the well.

32 Claims, 21 Drawing Sheets

19
64
69'
25
25'
23"
44
62
200
20
40/41
63
42
48'
48"
65
21
69
23'
43
23
66
44
67
12"
A
67'
A
8
61
58
57
10
9
12'
55
56
3
10"
10'
30
7
4'
35
31
2
68'
20'
68
69
67
66
62
55
61
A-A 400
30
20'
26
51
10
13
17
52
24
41
66'
45
42
44
52'
16
16'
11
31
32
43

UNDERWATER DEVICE AND METHOD FOR BLOCKING OUTFLOW OF A FLUID LIKE OIL OR GAS BY AN UNDERWATER WELL

This application is a 371 of PCT/IB2011/052721, filed on Jun. 21, 2011, which claims priority to Italian Patent Application No. PI2010A000073, filed on Jun. 21, 2010.

FIELD OF THE INVENTION

The present invention relates to a device and to a method for blocking the outflow of a pressurized fluid from an underwater well, in particular, for blocking the outflow of crude oil and/or of natural gas, for carrying out an operation of closure of the well.

In particular, the invention relates to a device and to a method for quickly stopping the flow and closing the well in case of incident and/or in case of fault of emergency shut-off devices of the underwater well, such as "blowout preventer" ("BOP") systems, in order to reduce harm to the environment and economic losses due to fluid outflow from the well.

TECHNICAL FIELD

Technical Problems

The oil and/or gas wells are normally equipped with so-called "blowout preventer" or "BOP" safety units. These devices are arranged at the end of a first withdrawal duct that is driven into the sea floor when a well is built, and comprise automatic or remotely operated shut-off and safety devices. BOP devices are arranged to prevent hydrocarbons escaping during the construction of the well and/or in case of faults of the well, to prevent hydrocarbons leaking into the sea, which would cause remarkable harm to the environment and economic loss.

Closing underwater damaged wells and/or wells whose safety devices are out of order is a particularly difficult work, due to the high turbulence of the fluid coming out of the well at a high pressure, and to the high hydrostatic pressure, which depends on how deep is the sea floor where the well is made.

Furthermore, the outlet mouth of the well may have a very irregular contour after a deep water explosion or cutting off operation that may have been carried out before closing the well.

U.S. Pat. No. 5,213,157 describes a clamping device for capping a pipe in which a fluid flows such as crude oil, water and the like, and an apparatus for mounting it on the pipe. The device is used, in particular, for blocking burning wells, and provides a gripper comprising clamping brackets for securement on the pipe, a capping element for insertion into the open end of the pipe, and securement members for securing the capping member to the brackets. The apparatus comprises closable jaws for securement to the brackets, and arms including a carrier element for carrying and positioning the capping member. The apparatus can be displaced, controlled and manipulated from a location at a safe distance from the pipe, and comprises a rod mechanism for rotating and closing the closable jaws engaging the brackets about the pipe, and for vertically displacing and rotating the arms in order to arrange the capping member into the open end of the pipe.

Also U.S. Pat. No. 5,158,138 relates to a method and to an apparatus for cutting off and closing an outlet tube of a well from which burning oil flows, wherein a vehicle comprises a reciprocating cable cut mechanism for cutting the tube above the ground level. The apparatus comprises a unit with a shut-off valve and a sealing element that are forced into the tube for tightly closing it. Such shut-off and sealing unit has a central elongated body or mandrel that has an inner channel which, in use, is in hydraulic connection with the inside of the well.

This operation means is not adapted to work in underwater conditions, e.g. very deep under the sea, and do not provide any underwater device which is suitable for sealing and safely stabilizing a well.

SUMMARY OF THE INVENTION

It is therefore a feature of the present invention to provide a device for blocking the outflow of a pressurized fluid from a free underwater well, i.e. from a well in which no shut-off means is working, such as in the case of an incident and/or in case a blowout preventer (BOP) shut-off safety means has gone out of order, in order to assist closing a well.

It is a particular feature of the invention to provide such a device which enables a quick and safe ultimate closure of a well.

It is also a feature of the present invention to provide such a device which can be used even very deep under the sea.

It is another feature of the present invention to provide such a device that can be used even if an irregular profile of the outlet mouth is available for the connection, such as in the case of an incident, e.g. of an explosion, or after cutting an outflow duct, in particular a BOP duct.

These and other objects are achieved by an underwater device for blocking the outflow of a pressurized fluid from an outlet mouth of a tubular extension of an underwater well, the device comprising:

a flow-retaining head that is adapted to engage with the outlet mouth preventing the pressurized fluid from flowing out of the tubular extension, the flow-retaining head having a lower portion which in use faces said outlet mouth and an upper portion opposite to said lower portion;

a support of the flow-retaining head;

wherein the main feature of the device is that it comprises:

a fastening means for fastening the support to the tubular extension;

an actuation means for carrying out a sliding movement of the flow-retaining head with respect to the support along a slide axis of the support towards the fastening means when the support is fixed to the tubular extension by the fastening means, between:

- a manoeuvre position in which the flow-retaining head is at a predetermined distance from the outlet mouth and said fastening means is fixed to said tubular extension, and
- a retaining position in which the flow-retaining head engages said outlet mouth, said distance of the flow-retaining head in the manoeuvre position selected in such a way that the support is fixed to the tubular extension by the fastening means while the flow-retaining head is still at a position where it is not affected by the outflow of the pressurized fluid, wherein the device has a channel that extends within the flow-retaining head between a lower passage port that is made at the lower portion and an upper passage port that is made at the upper portion.

The pressurized fluid may be crude oil, or natural gas, or a mixture of crude oil and of natural gas. The underwater well may be, in particular an undersea well at any desired depth. The tubular extension is typically a gas and/or oil tubular outlet element of a structure such as a blowout preventer (BOP) system of the well. The outlet mouth is a free end of the tubular extension.

The device according to the invention makes it possible to fasten and then to manoeuvre the flow-retaining head to engage the tubular extension, in order to avoid the outlet of the pressurized fluid, even if a high turbulence is present at the outlet mouth, due to the fluid escaping from the well at a high pressure. Therefore, the device according to the invention allows to work on an underwater well even if an emergency shut-off device, such as a BOP device, is absent or out of order; for instance, this may occur during the construction of the well, due to an incident such as an explosion.

A feed means of a fluid plugging material may be connected to the upper port so that the channel of the flow-retaining head can transfer such a fluid is material into the tubular extension of the well through the lower passage port. In particular, the channel allows to transfer a fluid plugging material that has a density and a consistency suitable for definitively closing the well, such as a mud, for example a mud which results from drilling the well, or a similar matter, which is normally available on offshore well platforms.

The plugging material may be a mud. An amount of mud is normally stored on the oil platforms as a working mud to be used while drilling new wells.

Nevertheless, the plugging material may be also a material that is adapted to harden within the tubular extension of the well, for example, it may be a cement or a resin.

In this case, the device may advantageously comprise an injection means for injecting the plugging material, in particular a mud injection means. A mud injection means may also be available on a surface means which normally operates wells or safety devices.

In particular, a feed means is provided for feeding a plugging fluid, the feed means comprising a feed duct with a first end that is hydraulically connected with the upper passage port of the channel of the flow-retaining head. The second end of the feed duct may be equipped with a fastening means for fastening to a duct or to a feed means of said plugging fluid. The feed duct or feed pipe may be a deformable duct that can unroll while positioning the device close to the tubular extension of the well at an underwater location. In particular, such deformable duct may comprise a flexible duct portion and/or a telescopic duct portion.

Advantageously, a discharge channel is provided which extends within the flow-retaining head, between a lower discharge port and an upper discharge port. This way, once said head has reached said retaining position, the discharge channel may be used for discharging a certain amount of oil and of gas, before continuing the step of plugging the well.

The device may comprise a shut-off valve. For example said shut-off valve may be arranged proximate to the flow-retaining head with an own inlet port connected to the upper passage port of the channel.

Advantageously, the device comprises an anti-freezing fluid feed means for feeding into the channel of the flow-retaining head an anti-freezing fluid, or a fluid that is adapted to prevent solids such as hydrocarbon hydrates from forming deposits, for example said fluid may be a glycol. In fact, hydrocarbons deposits may form when a fluid such as natural gas or crude oil, when coming out of the mouth of the well, comes into contact with the water of the waterbody. The anti-freezing fluid feed means, or the means for feeding a fluid to prevent solid formation, may comprise a duct that is inserted through the channel of the flow-retaining head, preferably it may also comprise a pump of suitable pump head.

In an exemplary embodiment of the device, the flow-retaining head comprises an elongated flow-retaining element that is adapted to be inserted into the tubular extension, the elongated flow-retaining element having a minimum cross section that is closer to a front end of the elongated flow-retaining element, and a maximum cross section that is closer to a rear end of the elongated flow-retaining element opposite to the minimum cross section, and cross sections whose area increases intermediate between the minimum cross section and the maximum cross section. In particular the elongated flow-retaining element has a conical shape or a frusto-conical shape, or an ogive or ellipsoid shape. The elongated, possibly tapered shape, of the flow-retaining element makes it easier to introduce it into the tubular extension of the well through the outlet mouth, even in strong turbulence conditions created by the outflow of the pressurized fluid.

The shape features of the flow-retaining element, for example the opening angle and/or the height of the cone, are selected taking into account such conditions as the pressure, the physical features of the fluid, and the depth of the submerged position, besides the size of the outlet mouth.

In an exemplary embodiment, the flow-retaining head has a plastically deformable seal means, wherein a metal material is arranged on an outer surface of the flow-retaining head whose hardness is lower with respect to the material of which the tubular extension is made at the outlet mouth, such that the plastically deformable seal means is adapted to slidingly engage on the outlet mouth buckling and creating a seal by plastic deformation. Such lower hardness metal material is preferably a steel having modular portion of elasticity and/or yield strength lower with respect to the material of which the is tubular extension is made at the contour of the outlet mouth. For example, the lower hardness metal material may be a mild steel.

Advantageously, the plastically deformable seal means comprises a layer of a low hardness metal material deposited about a removable element of the flow-retaining head. This way, it is possible to replace a worn deformable seal means after the device has been used once or more times. Furthermore, it is possible to provide the device with serially produced flow retaining heads, and to adapt the seal means to the features of the material of the tubular extension of the well.

In another exemplary embodiment, the flow-retaining head has an elastically deformable seal means where a material is arranged on an outer surface of the flow-retaining head, which is more deformable with respect to the material of which the tubular extension is made at the outlet mouth, such that the elastically deformable seal means is adapted to elastically buckle creating a seal at a contour portion of the outlet mouth in a final phase of the sliding approaching step.

The material of the elastically deformable seal means may be selected according to the conditions of the well and to the features of the crude oil and/or the gas; preferably it is selected among the materials based on thermoplastic polymers such as polyethylene terephtalate (PTFE), or is selected among hard rubbers.

In a further exemplary embodiment, a combination of an elastically deformable seal means and of a plastically deformable seal means is provided, in order to contain at best the contour of the outlet mouth, and to ensure in any case a seal during the sliding approach of the flow-retaining head.

In a preferred exemplary embodiment, the flow-retaining head comprises a bush portion that is provided with a substantially co-axial channel with a first cylindrical portion of smaller diameter for fixing the element to the bush portion, and with an adjacent second cylindrical portion of larger diameter in use facing the flow-retaining element, the second portion having a filling of said more deformable material which forms the approach seal portion.

The fastening means may comprise a plurality of teeth that are arranged along respective radial directions towards the longitudinal axis of the device, the teeth slidable along the respective radial directions within respective housings that are integral to the support, the teeth having respective inner ends that are adapted to engage with the tubular extension of the well. This allows to achieve a steady centering and fastening of the support with the tubular extension of the well.

In particular the teeth are adapted to engage with a protrusion of the tubular extension. In particular, the teeth may engage with the protrusion in an undercut engagement. Alternatively, the teeth may engage with the protrusion by means of a clamp engagement. In particular, the protruding portion may be a flange of the tubular extension.

The teeth may have a hydraulic actuation means, in particular a hydraulic cylinder-piston unit.

Alternatively, an actuation means is provided which is arranged to be operated by a ROV-type (Remotely Operated Vehicle) that is suitable for underwater operation, in particular for undersea operations at high depth. In particular, the actuation means is arranged at external ends of said teeth.

The teeth may have respective pins that slidingly engage with elongated holes that are made within the respective seats. Furthermore, a lock means is provided for locking the sliding movement of the pins in the elongated holes, and then the movement of the teeth within respective housings of centering blocks, the lock means adapted to be handled by such a ROV-type vehicle.

In an exemplary embodiment of the invention, the actuation means of the sliding movement of the flow-retaining head comprises at least one hydraulic actuator unit comprising an actuation chamber, an actuation piston slidingly arranged within the actuation chamber, and an actuation means for causing the actuation piston to slide within the actuation chamber between:

a rearward position and an extended position, at which a portion of the actuation piston extends outside of one end of the actuation chamber, more than at the rearward position, the actuation chamber and the actuation piston respectively integral to the flow-retaining head and to the support of the device, or vice-versa, such that, by operating the actuation means and by bringing the hydraulic actuator unit from the rearward position to the extended position, or vice-versa, the flow-retaining head performs the sliding approach towards the fastening means i.e., in use, towards the outlet mouth of the tubular extension of the well. Such solution allows a substantially step-by-step control of the sliding approach, according to conditions such as the pressure, the physical characteristics of the fluid, and the depth.

In particular the actuation means comprises a control circuit that is hydraulically connected with a source of an actuation fluid and with the actuation chamber, in order to transfer the actuation fluid from the source to the actuation chamber and in order to create a sliding movement of the actuation piston within the actuation chamber, wherein the source of the actuation fluid has a pump means in common with an actuation circuit of an auxiliary device or of a device associated with the well. Such auxiliary device or such device associated with the well may be, for example, an emergency device such as a ROV-type device that is adapted to transfer and to arrange the underwater device at the outlet mouth of the well.

Advantageously, said control circuit is adapted to transfer an actuation mud into the actuation chamber, in order to use it as a fluid for transferring a motive-power to the hydraulic actuator unit. Such mud control circuit may have a pump means in common with a circuit of the mud associated with the well. Since the mud circuits are equipped with pump groups having high pump head, the actuation chamber may be supplied with a mud that may be available at a pressure that is high enough to prevail over the upward thrust that the flow-retaining head, while approaching to the outlet mouth, receives from the pressurized fluid that flows out of the well, even at a high outlet pressure. Therefore, the device according to the invention allows bringing the flow-retaining head from the actual manoeuvre position to the retaining position in any conditions, without equipping the well with a hydraulic dedicated control unit that is adapted to supply oil at a pressure high enough to prevail over the upward force that is received by the flow-retaining head.

Furthermore the device may comprise:

a compensation container;

an compensation element movably arranged within the compensation container, the compensation element defining within the compensation container a primary room and a secondary room, wherein the primary room is hydraulically connected with the source of an actuation fluid, wherein the secondary room is hydraulically connected with the actuation chamber.

In an exemplary embodiment, said hydraulic actuator unit comprises, in addition to the actuation chamber and to the actuation piston:

a balancing chamber, a balancing piston integral to the actuation piston and slidably arranged within the balancing chamber, and a balancing means for applying a balancing force to the balancing piston responsive to an internal pressure of the tubular extension of the well, the balancing force having the same direction as the sliding approach.

This way, said flow-retaining head receives a balancing force that is directed towards the tubular extension and that is opposite to the force that the flow-retaining head receives from the pressurized fluid at the outlet of the tubular extension. Therefore, a relatively small actuation force i.e. a relatively small actuation pressure on the actuation piston is enough for bringing the flow-retaining head close to the outlet mouth, since this actuation force has the same direction as the balancing force that acts on the balancing piston, which is opposite to the upward force that is exerted by the fluid that flows out of the well. In particular, the flow-retaining head may be brought close to the outlet mouth of the well by means of a conventional hydraulic control unit or by means of an accumulator of an auxiliary emergency actuating device of the well, for example of a ROV vehicle. It is therefore possible to bring the flow-retaining head to the outlet mouth without equipping the underwater device with a high prevalence hydraulic pump means that is adapted to supply an actuation fluid at a pressure that is high enough, alone, to cause the movement.

In particular the balancing means comprises a compensation container and a compensation element that is movably arranged within the compensation container, the compensation element defining within the compensation container a primary room and a secondary room, wherein the primary room is hydraulically connected with the tubular extension, and the secondary room is hydraulically connected with the balancing chamber. In particular, the primary room is hydraulically connected with the tubular extension through the channel of the flow-retaining element, in particular through the upper passage port of the channel. For example, a duct can be provided, as well as a pressure gauge can be provided on a connection duct that is connected to the upper passage port of the channel.

Advantageously, the device comprises a lock means for locking the flow-retaining head at the retaining position, such that, by releasing the actuation means, in particular releasing the actuation means of the hydraulic actuator unit, the flow-retaining head remains in the retaining position, thus preventing an outflow of the pressurized fluid from the well.

In particular the actuation chamber and the actuation piston are arranged coaxially to the slide axis and are respectively integral to the support and to the flow-retaining head, and the lock means comprises at least one longitudinal guide element integral to the support and a movable element integral to the flow-retaining head, the at least one longitudinal guide element and the movable element slidingly engaging each other, the at least one longitudinal guide element and the movable element adapted to be blocked with respect to each other. In particular, the at least one longitudinal guide element is a tie-member arranged between a first plate of the support that is arranged near the fastening means, and a second plate that is integral to the first plate and is arranged at a predetermined distance from the first plate, and the movable element is a movable plate that is integral to the flow-retaining head and has at least one through hole with which the at least one tie-member is slidably engaged, the movable plate adapted to be blocked with respect to the tie-member, preferably, by a weld connection. This way, by blocking the movable plate with respect to the longitudinal elements after bringing the flow-retaining head to the retaining position, it is possible to remove the actuation means of the flow-retaining head, in particular the hydraulic actuator unit, which may be reused. For example, it is possible to cut the longitudinal elements or tie-members at a position beyond the movable plate.

Advantageously, the portion of the piston which extends out of the actuation chamber comprises a hollow end portion that abuts against the movable element and is adapted to contain the shut-off valve.

Furthermore, the feed duct of the plugging fluid comprises a passageway selected from the group consisting of:

a passageway through the piston and the actuation chamber;

a passageway made transversally with respect to said piston.

In other words, the end of the co-axial piston may have a tubular portion, i.e. a cup element of a size suitable for containing the valve, wherein the tubular portion transmits the force exerted by the hydraulic actuator for advancing the flow-retaining head without stressing the valve, which is arranged at the end of the flow-retaining head and abuts the plate or the movable element of the lock means of the flow-retaining head.

In particular, the valve may be a valve of a blowout preventer (BOP)-type equipment. In practice, since a blowout preventer is already present as a wellhead equipment, the above corresponds to a serial arrangement of two BOPs. By exploiting a modularity of the BOP systems, the second one may be sized to stress the existing structure at least as possible.

In an alternative exemplary embodiment, the hydraulic actuator unit is a double-acting actuator unit.

In a further alternative exemplary embodiment, a plurality of piston actuating hydraulic groups can be provided, which are arranged about the slide axis and have respective pistons and cylinders parallel to the slide axis. In particular, each piston has its free end, i.e. an end that is not engaged in the respective cylinder, which is integral to the support, whereas the cylinders have respective opposite ends that are integral to one another by a rod or a cross-like connection that is integral to the flow-retaining head such that, by advancing the pistons within the cylinder, the connection element is caused to approach the fastening means and, in use, the outlet mouth. In this further alternative exemplary embodiment, no mechanical parts are provided along the axis of the flow-retaining head, in particular no cylinders and/or pistons are provided, which simplifies the montage of the valve and of the duct. Advantageously, the connection rod has a hole as an extension of the channel of the flow-retaining head, with which it is hydraulically connected, and the cross-like connection has an outer surface that is suitable for fastening duct elements to provide a hydraulic continuity of the feed channel of the plugging fluid with the valve and the feed duct.

In an exemplary embodiment, the actuators of the sliding movement of the flow-retaining head comprises an electric actuation unit that is suitable for underwater installation.

In a possible exemplary embodiment, the hydraulic actuator unit comprises a plugging fluid inlet duct adapted to operate at first the hydraulic actuator unit and to cause the sliding movement of the flow-retaining head with respect to the support along the slide axis from the manoeuvre position to the retaining position, and a shut-off valve is provided which is adapted to connect the duct with the channel so that the plugging fluid floods and pressurizes the well starting from the outlet mouth. This way, it is possible to use the same working fluid, for example pressurized plugging mud, which is used for plugging the well, also for causing the movement of the flow-retaining head from the manoeuvre position to the retaining position. A saving is therefore obtained with respect to the case in which a specific pressurized hydraulic fluid is provided tp operate the hydraulic actuator.

Advantageously, the actuation means comprises a worm screw adapted to be pivotally operated by the electric actuation unit, and the flow-retaining head comprises a nut screw, wherein the worm screw engages the nut screw, in order to provide the sliding movement of the flow-retaining head. Since the operation occurs by means of a screw and of a nut screw, a substantially fine control of the sliding approach can be provided.

Preferably, the ducts, the dimensions of the flanges and of the mechanical components are at least in part selected among prefixed standards, for example API standards. This way, it is possible to include the device within the on board emergency equipment of the emergency vehicles, where the device may be stored dismantled and may be assembled when required, a minimum means and time being needed, in particular without further machining and adjustment needed.

According to another aspect of the invention, a method is provided whose operation steps may be carried out by means of the above indicated device, and with reference to the claims attached herein.

BRIEF DESCRIPTION OF THE DRAWINGS

The invention will be made clearer with the description of exemplary embodiments thereof, exemplifying but not limitative, with reference to the attached drawings, in which the same reference characters indicate the same or similar parts, throughout the figures of which:

FIG. 17' shows a further exemplary embodiment of the device according to the invention;

DESCRIPTION OF PREFERRED EXEMPLARY EMBODIMENTS

Figure 1:
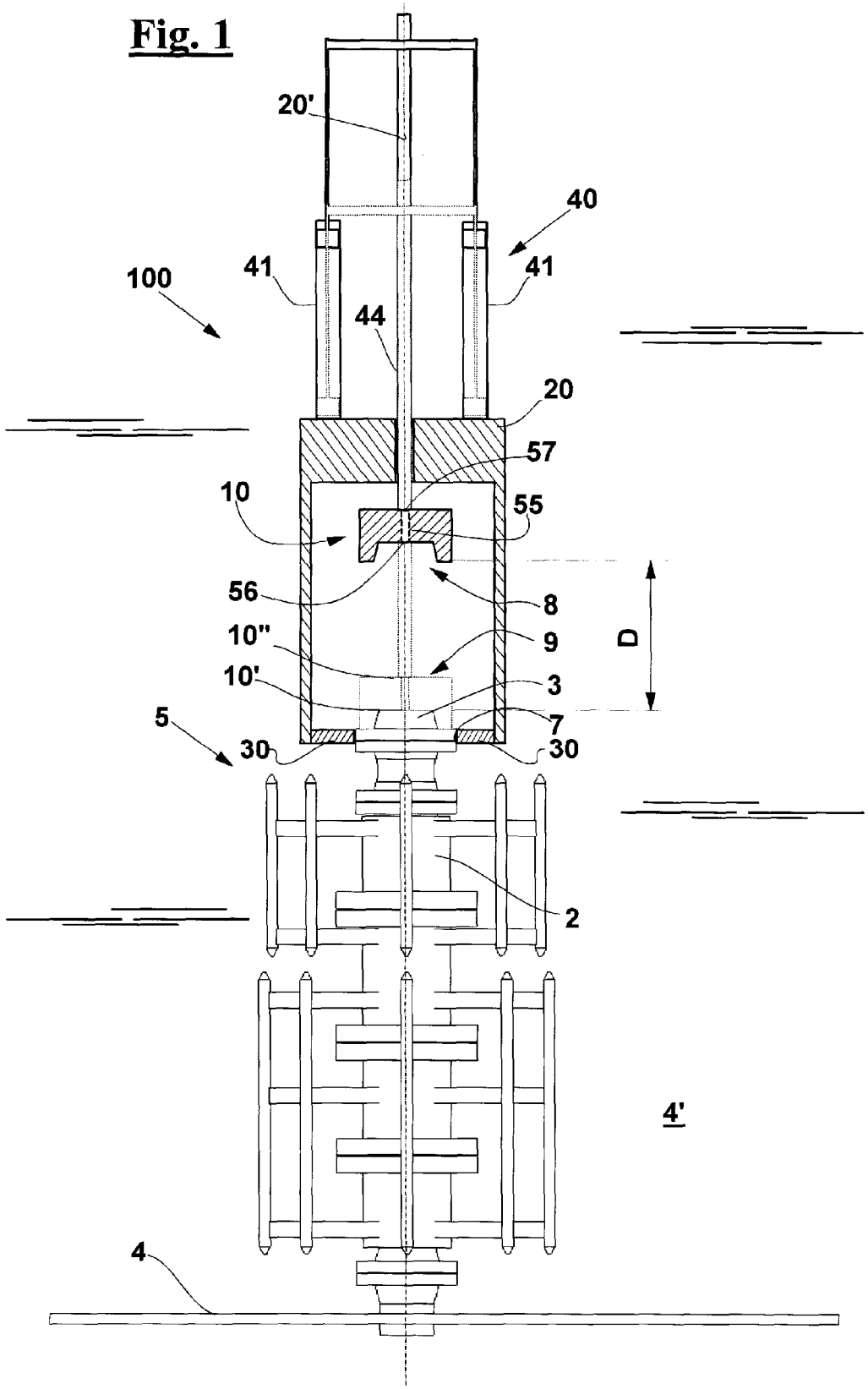
FIG. 1 shows diagrammatically a device according to the invention, with the fastening means that engages a tubular extension of an underwater well equipped with a blowout preventer type device.

FIG. 1 shows a device 100, according to the invention, for blocking the outflow of a pressurized fluid from a crude oil and/or natural gas underwater well. FIG. 1 shows also a blowout preventer (BOP)-type shut-off and safety device 5 of an underwater well. The BOP device comprises a tubular extension 2 protruding from a floor 4 of a waterbody 4', and has an outlet mouth 3, as well as shut-off devices, not shown. Device 100 comprises a support 20 and a flow-retaining head 10 that is slidingly arranged with respect to support 20 along a slide axis 20'. Flow-retaining head 10 is adapted to engage with outlet mouth 3.

In the exemplary embodiment of FIG. 1, support 20 is fixed to BOP 5 by fastening means 30 that engage a flange 7 available proximate to outlet mouth 3. Flow-retaining head 10 is shown in full lines at a manoeuvre position 8, where flow-retaining head 10 is at a distance D from outlet mouth 3, and is shown in dotted lines at a retaining position 9 where flow-retaining head 10 engages outlet mouth 3 and covers tubular extension 2, in order to prevent the fluid from flowing out of the well. An actuation means 40 is provided for performing a sliding movement of flow-retaining head 10, between manoeuvre position 8 and retaining position 9, the actuation means comprising, in a represented exemplary embodiment, hydraulic cylinder-piston units 41, which are diagrammatically shown herein. Actuation means 40 allow performing the sliding movement when support 20 is fixed to tubular extension 2 through fastening means 30.

At retaining position 9, outlet mouth 3 detects on a surface of flow-retaining head 10 a lower portion 10', facing tubular extension 2, as well as an upper portion 10" that is arranged around tubular extension 2. Flow-retaining head 10 has a channel 55 that extends inside it between a lower passage port 56 that is made at lower portion 10' and an upper passage port 57 that is made at upper portion 10".

Channel 55 is used for introducing a plugging material into tubular extension 2, i.e. a fluid of density and consistency suitable for plugging, i.e., for definitively closing the well, after firmly placing flow-retaining head 10 in order to prevent the pressurized fluid from flowing out of tubular extension 2. The plugging material may be a mud which is produced by drilling the well, and which is kept available on a surface structure of the well, not shown. The plugging material is fed into channel 55 through upper passage port 57, which communicates with a feed duct of a plugging fluid, not shown, connecting upper passage port 57 of channel 55 with the surface structure.

Figure 16:
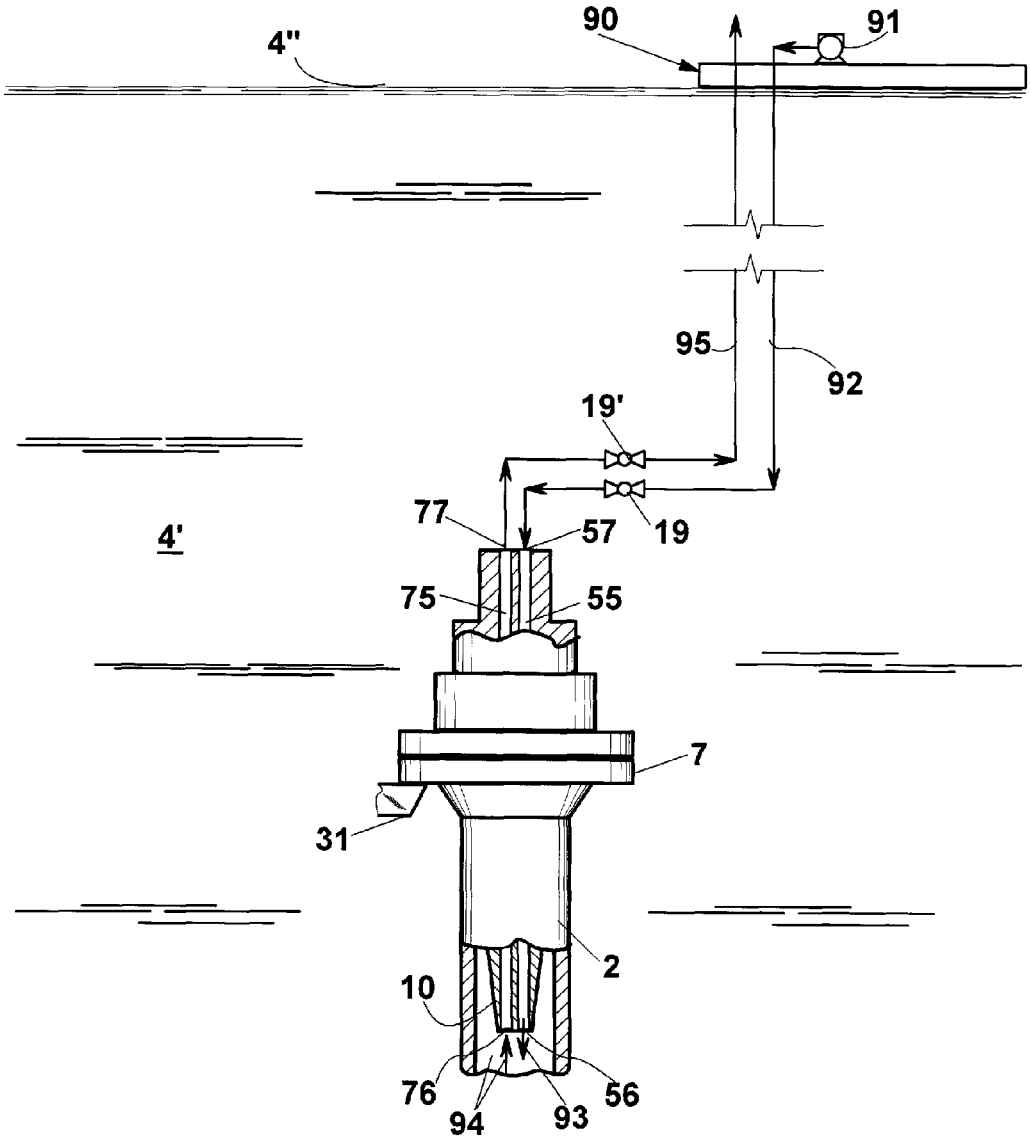
FIG. 16 is a diagram that diagrammatically shows a step of plugging the tubular extension of a well carried out after the flow-retaining step, as shown in FIGS. 12-15.

As shown in FIG. 16, passage port 57 may be directly connected to a flexible plugging fluid feeding duct 92, and to a shut-off valve 19. Shut-off valve 19 may be arranged on a surface structure 90 of the well.

Figures 3, 3A, 3B:
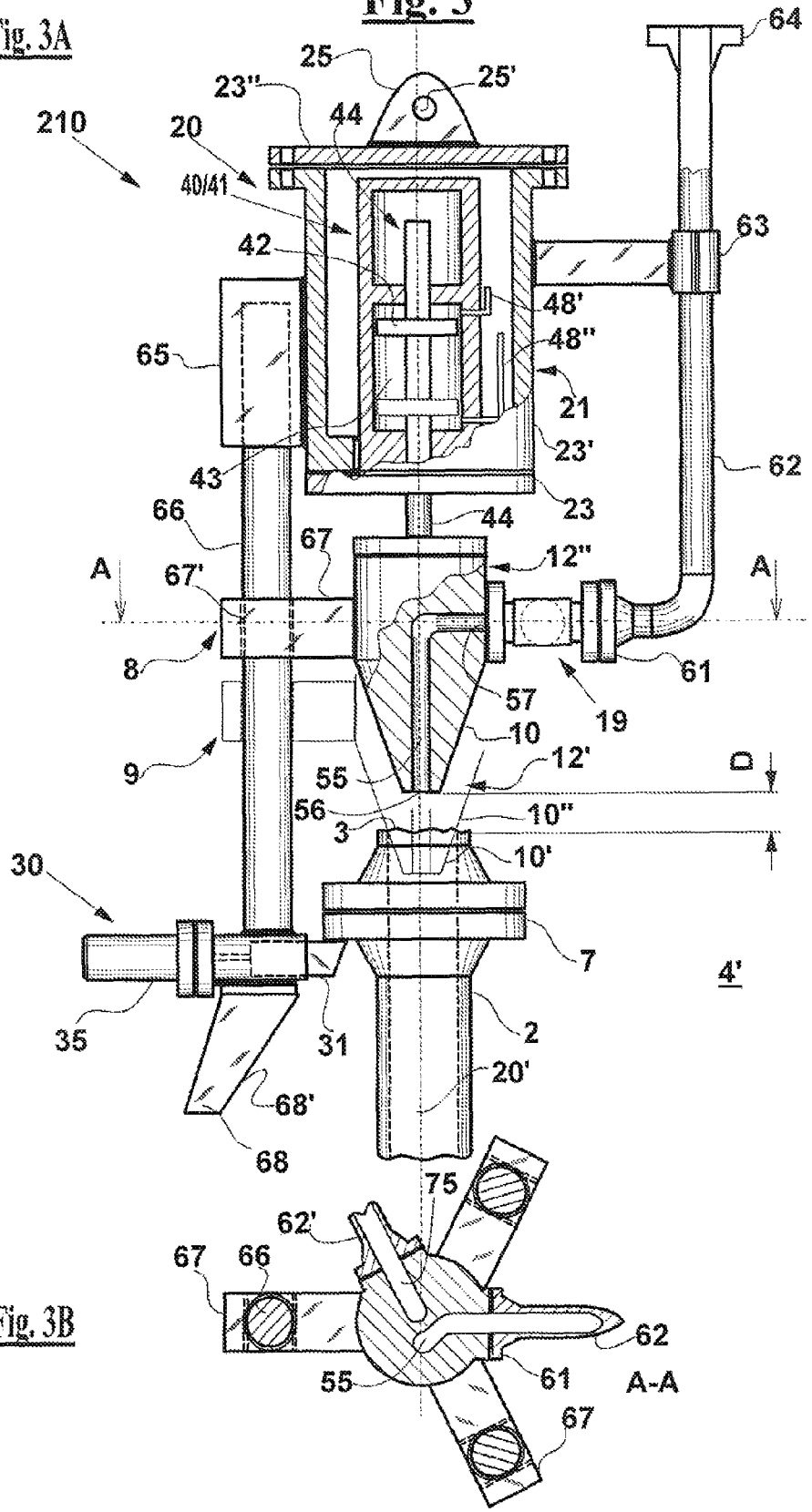
FIG. 3 is a partial section view of an exemplary embodiment of the device of FIG. 2.
Figure 7:
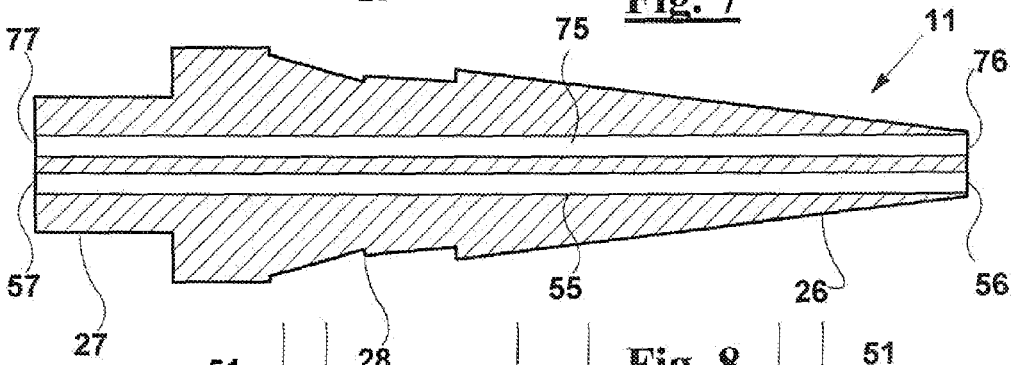
FIG. 7 is a cross sectional view of the detail of FIG. 6.

In the exemplary embodiment of FIG. 7, a discharge channel 75 is defined within flow-retaining head 1', which extends between a lower passage port 76 and a upper port 77. Discharge channel 75 may be used for extracting the matter that is present inside tubular extension 2 when the plugging material is delivered through channel 55, which makes it easier to deposit the plugging material. The feed channel of plugging fluid 55 and the discharge channel are connected to respective feed and discharge fittings or ducts 62,62'. Shut-off valves 19 are also provided to hydraulically connect feed and discharge channels 55,75 with ducts 62,62' (FIG. 3).

Figures 2, 2A, 2B:
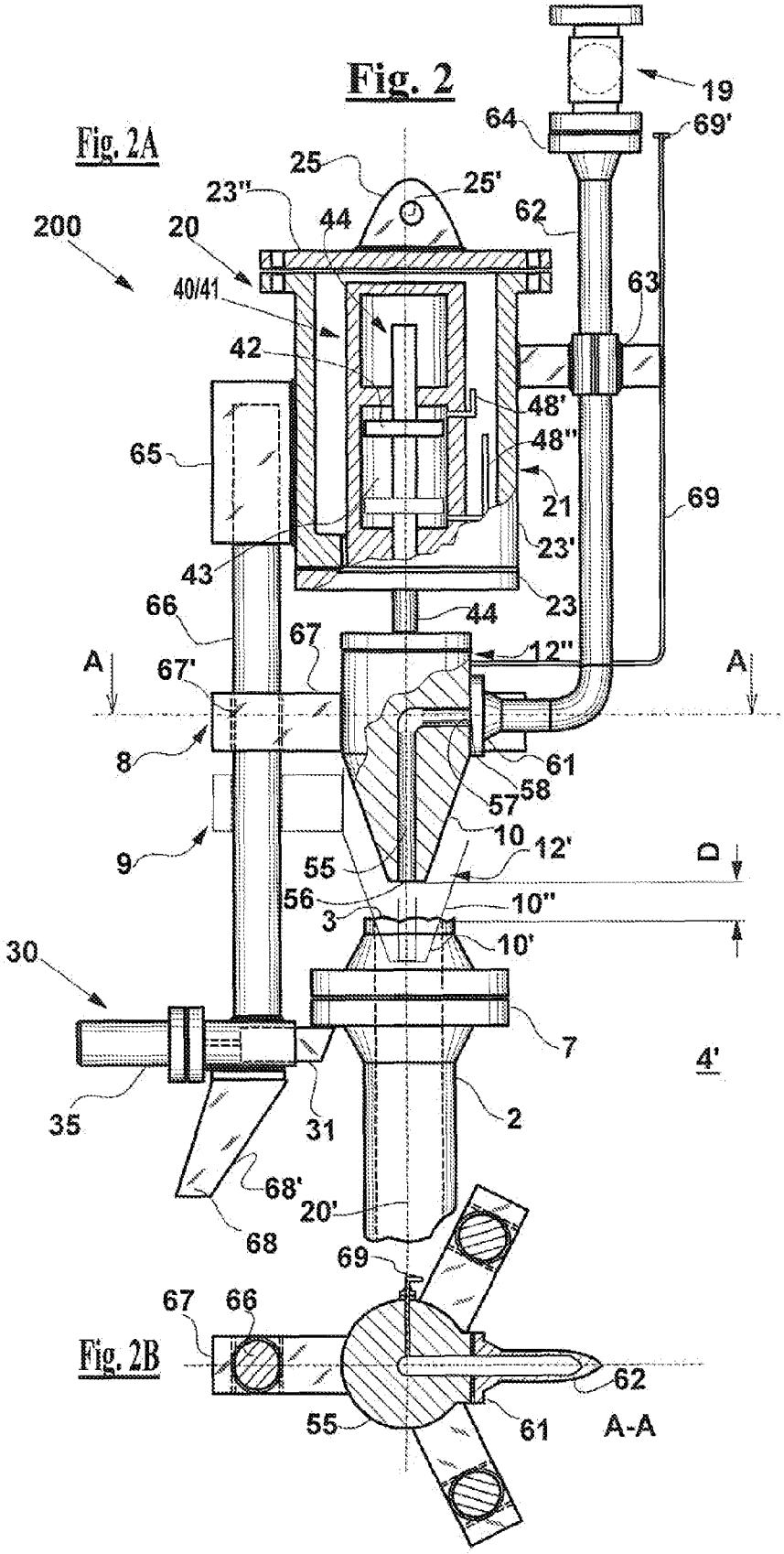
FIG. 2 is a partial section view of a device according to an exemplary embodiment of the invention.

FIG. 2 shows a device 200, according to an exemplary embodiment of the invention, which comprises the same elements as device 100, described with reference to FIG. 1, and has an elongated flow-retaining head 10. Elongated flow-retaining head 10 has transverse sections that increase from a minimum size of an end portion 12', which in use faces outlet mouth 3, to a maximum size of an end portion 12" opposite to minimum size transverse section. In this case, elongated flow-retaining head 10 comprises a substantially frustum-conical portion, but it may also have the shape of a solid of revolution obtained by revolving a curved line.

In device 200, actuator 40 (FIG. 2) of flow-retaining head 10 comprises a single hydraulic actuator unit 41 that is arranged along slide axis 20' of flow-retaining head 10, i.e. co-axially to flow-retaining head 10. Support 20 comprises a cylindrical box 21. Furthermore, the hydraulic actuator unit is arranged in cylindrical box 21. In particular, a base element 23 of hydraulic actuator 41 provides an end flange of cylindrical box 21 of support 20.

Hydraulic actuator 41 comprises a cylindrical actuation chamber 43 and a piston 42 sliding within actuation chamber 43. Piston 42 is integrally connected to flow-retaining head 10 through a stem 44 arranged co-axially to flow-retaining head 10 and to actuator 41. Chamber 43 has hydraulic connection elements 48' and 48" of a hydraulic control circuit 47 (FIGS. 17-19), for conveying a hydraulic fluid, in particular a hydraulic oil, into an upper portion and into a lower portion or from an upper portion and from a lower portion of actuation chamber 43, respectively, wherein the lower portion and the upper portion are defined by piston 42.

Cylindrical box 21 also comprises a cylindrical shell 23' and an upper end flange 23" that has an outer ring bolt 25 with a grip hole 25' for conveying device 200 from water body surface to the well, and vice-versa.

Support 20 is also provided with guide means of flow-retaining head 10, which comprises a plurality of preferably cylindrical uprights 66, each integral to cylindrical box 21 through a respective connection element 65 that is connected to support 20. Flow-retaining head 10 is slidingly connected to uprights 66 through radial elements 67, which are provided with through holes 67' for sliding along uprights 66. For the sake of clarity, only one upright is shown in FIG. 2, in a schematic representation. For example, uprights 66 may be at least three. In particular, uprights 66 are angularly spaced apart at an angular pitch.

A centering means 68 may also be provided for assisting positioning device 200 at a deep location, coaxially to tubular element 2 of the well. In particular, the centering means may comprise centering plates 68 radially arranged with respect to axis 20' of device 200. In order to assist centering, centering elements 68 preferably have a slope 68' that is inclined away from axis 20'.

Device 200 is also provided with a fastening means 30 which comprises a plurality of teeth 31 that are arranged along respective radial directions towards axis 20'. In the exemplary embodiment shown herein, each tooth is integral to an upright 66 of the guide means of flow-retaining head 10. Teeth 31 can slide towards axis 20' within respective housings defined by blocks 32 that are integral to uprights 66, and have respective inner engagement ends that in use engage with tubular extension 2. In the exemplary embodiment shown herein, such engagement ends may engage, according to an undercut engagement, with a radial protruding portion of tubular extension 2, in particular with flange 7, proximate to outlet mouth 3. Fastening means 30 also comprises a hydraulic cylinder-piston unit 35 for moving each tooth 31.

At upper passage port 57, channel 55 has a tube connection means 58 for connecting channel 55 to an out-of-water environment. For example, connection means 58 may comprise a face flange, not shown, that is integral to the surface of flow-retaining head 10, in particular to the surface of a cylindrical portion of the flow-retaining head.

Device 200 also comprises a connection duct 62 which extends between channel 55 of flow-retaining head 10 and a duct, not shown, for connection to a surface platform. Connection duct 62 has a fastening means for fixing channel 55 and the surface duct, for example it has two flanges 61,64. Connection duct 62 is preferably integral to cylindrical support 20, for example through a sleeve 63 which comprises a first half portion connected to support 20 and a second half portion that can be connected to the first half portion by means of screws, not represented.

A shut-off valve 19 is also provided, for example a ball valve, for preventing a pressurized fluid from flowing out of tubular extension 2 of the well, which may occur after positioning device 200 at the retaining position, and before feeding a plugging material, i.e. a fluid of density and consistency suitable for definitively closing the well, e.g. a mud.

FIG. 3 shows a device 210 similar to device 200, according to an exemplary embodiment, where valve 19 is arranged between flow-retaining head channel 55 and connection duct 62. Independently from this, device 200 (FIG. 2) also comprises a tube 69 for feeding an anti-freezing liquid, or in any case a liquid adapted to prevent solid formation, into channel 55 and into feed duct or connection 62, in particular for feeding a glycol. Tube 69 is fixed to the inner walls of connection duct 62 and of the feed duct, not shown, according to the known methods, and may comprise deformable i.e. flexible portions. Tube 69 has a connection means 69' arranged between an inner portion of the connection duct and an internal portion of the plugging fluid feed duct.

Figure 9:
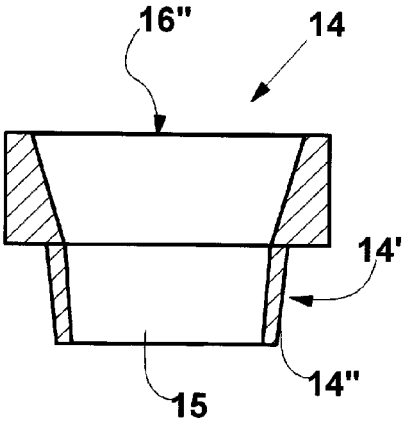
FIG. 9 is a cross sectional view of a plastically deformable removable seal element of the flow-retaining head of the device of FIGS. 4 and 5.
Figure 10:
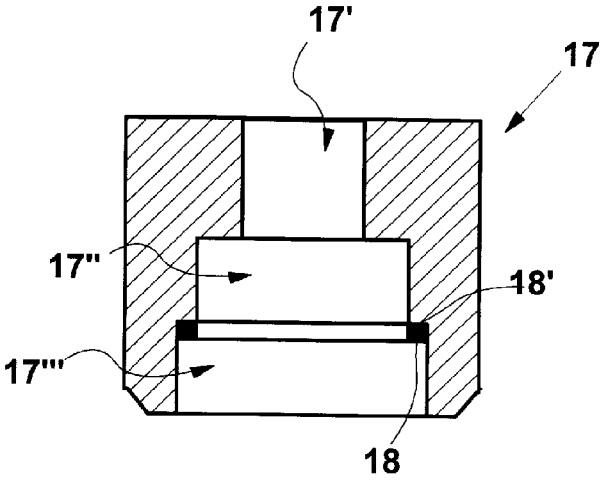
FIG. 10 is a cross sectional view of an elastically deformable removable seal element of the flow-retaining head of the device of FIGS. 4 and 5.

A device 300 according to another exemplary embodiment of the invention is described with reference to FIGS. 4 to 11. Device 300 has the same features as device 200, as indicated by the reference numbers. In particular, device 300 has an elongated flow-retaining head 10 that comprises a substantially conical flow-retaining portion or element 11, which is shown more in detail in FIGS. 6 and 7. Other components of flow-retaining head 10 are shown in FIGS. 9 and 10.

Figure 5:
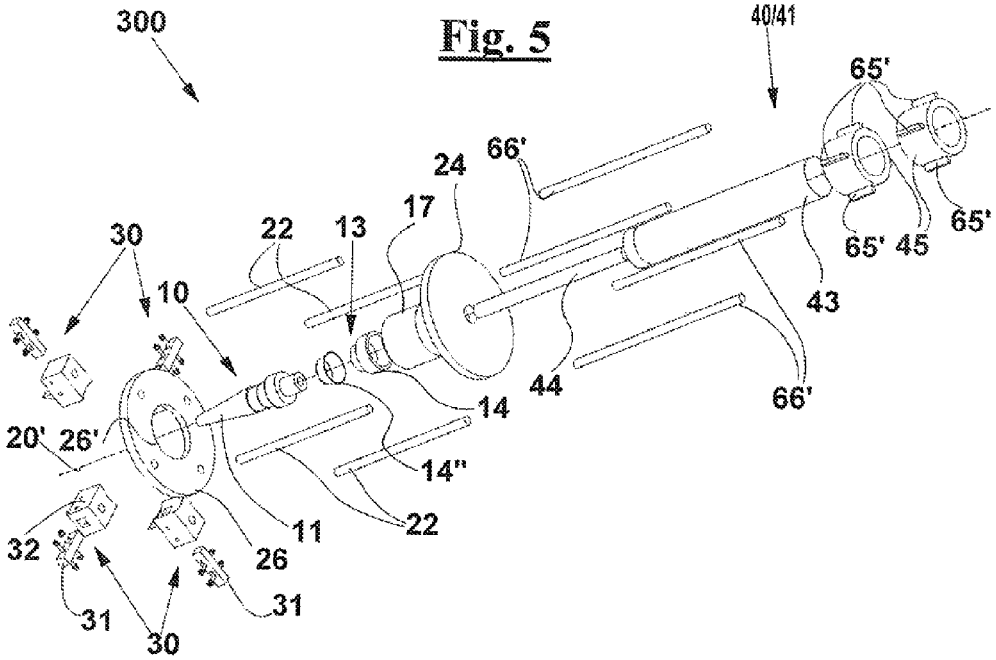
FIG. 5 is an exploded perspective view of the device of FIG. 4.
Figure 8:
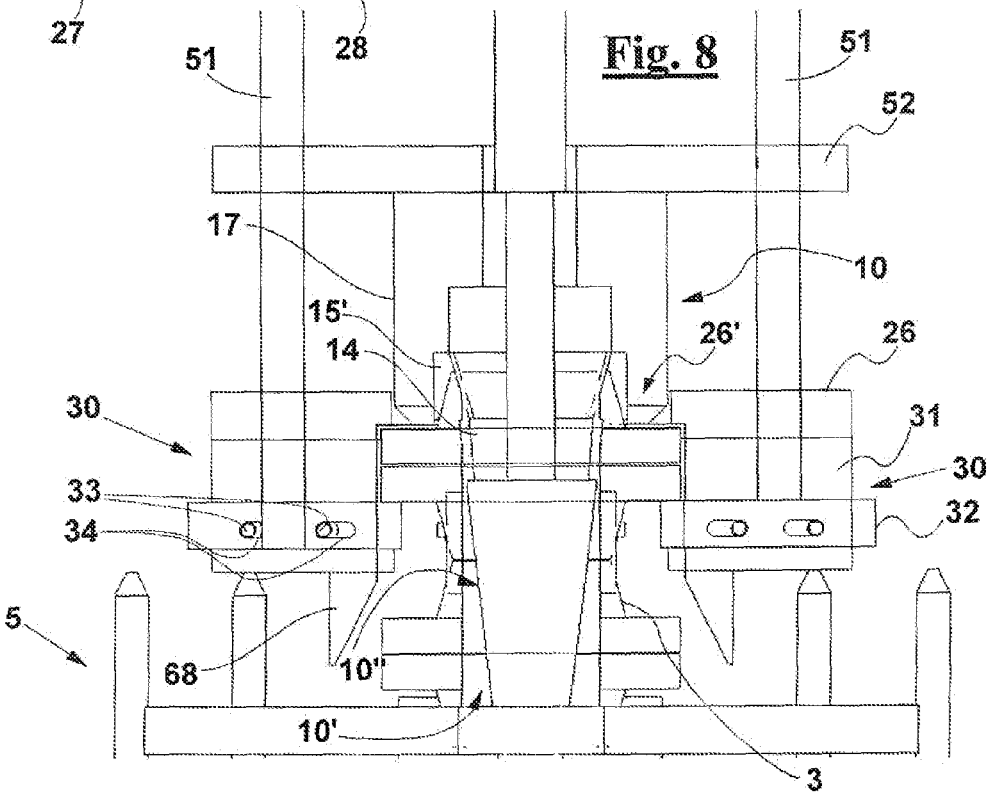
FIG. 8 is a partial cross sectional view of a device according to an exemplary embodiment of the invention, with the fastening means engaged with a flange associated with the outlet mouth, before blocking the outflow.

With reference to FIGS. 5 and 8, flow-retaining head 10 has a seal means consisting of a combination of a plastically deformable seal portion 13 and of an elastically deformable seal portion 15.

Plastically deformable portion 13 comprises a metal material less hard than the material of which tubular extension 2 is made at outlet mouth 3. For example, plastically deformable portion 13 may be made of mild steel. In use, plastically deformable portion 13 slidingly engages against the contour of outlet mouth 3. As FIGS. 5 and 9 show, the plastically deformable seal 13 may comprise a releasable seal ring 14 that has a frusto-conical outer face 14' on which a plating 14" is formed starting from the lower hardness metal material. Plating 14" may be integral with outer face 14', or may be a removable element, as shown in FIG. 5. Releasable seal ring 14 has a channel 15 for mounting about an intermediate portion 28 of element 11, which is shown more in detail in FIGS. 6 and 7.

In the sectional view of FIG. 7 a longitudinal channel 55 is shown that extends within elongated flow-retaining element 10 between passage ports 56 and 57, and a further longitudinal discharge channel 75 is also shown that extends between passage ports 76 and 77. Discharge channel 75 is used for causing the material present in tubular extension 2 to be discharged when the plugging material is delivered through channel 55, in order to make assist deposit of the plugging material. In a represented exemplary embodiment, longitudinal channels 55 and 75 are both substantially parallel to the longitudinal axis of elongated flow-retaining element 10, and passage ports 76 and 77 are made near passage ports 56 and 57, respectively.

Figure 4:
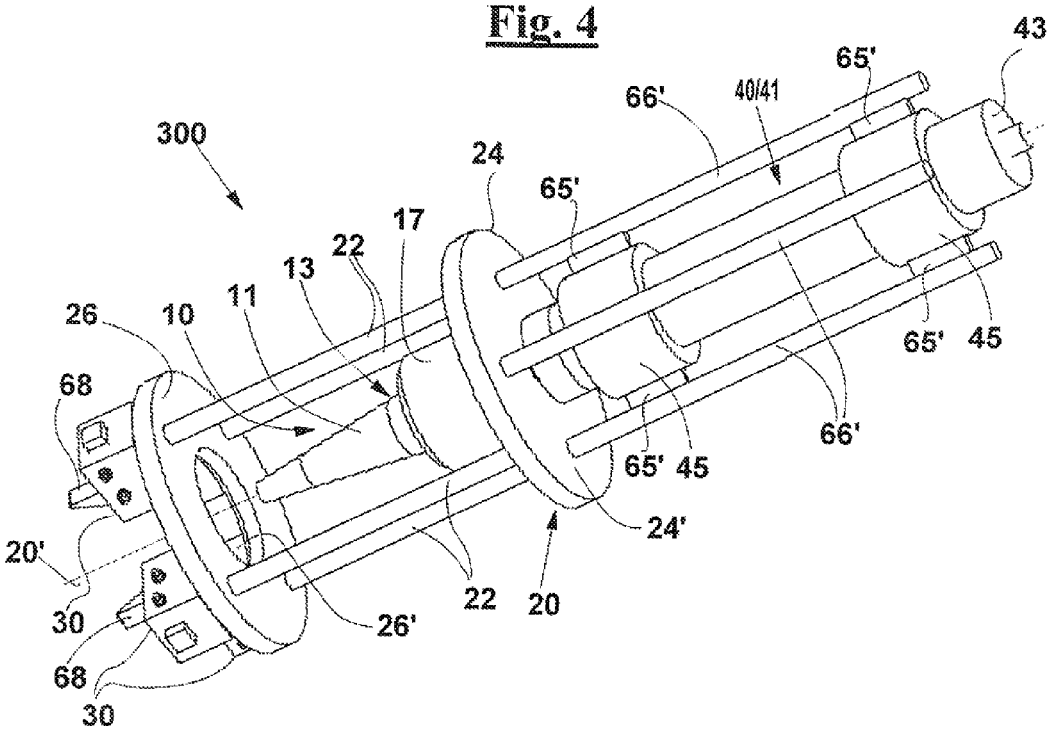
FIG. 4 is a perspective view of a device according to another exemplary embodiment of the invention.
Figure 6:
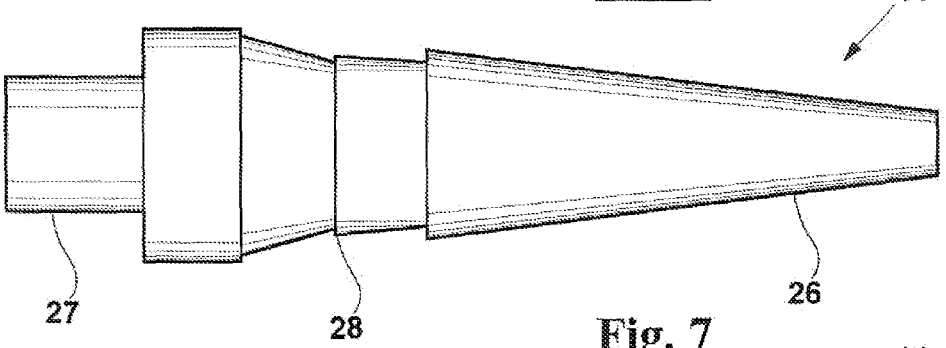
FIG. 6 is an elevation side view of a flow-retaining element of the flow-retaining head of the device shown in FIGS. 4 and 5.

The elastically deformable seal portion comprises a resilient material that is much more deformable than the material of which tubular extension 2 is made. For example, the elastically deformable seal portion is made of a polymeric material such as polytetrafluorethylene (PTFE), or of an elastomeric material. As shown in FIGS. 4, 5 and 10, the elastically deformable seal portion comprises a removable bush element 17, which has an inner cavity with two substantially coaxial cylindrical portions 17' and 17", for fixing cylindrical rear portion 27 of flow-retaining element 11 (FIGS. 6 and 7). The cavity of bush element 17 has a further cylindrical portion 17'", wider than portions 17' and 17" and facing in use flow-retaining element 11, which has a seal portion 18, in particular at a shoulder 18' between portions 17'" and 17". More in particular, the seal portion comprises a seal ring 18 that is housed within portion 17'" of the cavity and is mounted in order to abut on the shoulder. The seal portion is made of a resiliently deformable material. When flow-retaining head 10 approaches retaining position 9 (FIGS. 1 and 2), seal portion 18 shrink resiliently and creates a tight connection at the contour of outlet mouth 3.

The releasable sealing elements 14 and 17 are shown in FIG. 8 mounted to element 11.

In device 300, support 20 comprises two plates 26 and 24, which in this case are round discs, and a plurality of spacer elements 22 that connect rigidly round discs 26 and 24 to each other, such that the latter are parallel to each other and are aligned along axis 20', at a predetermined distance L. In the exemplary embodiment shown herein, four longitudinal spacer elements 22 are arranged parallel to one another about axis 20', and angularly spaced apart at an angular distance. Disc 26 has a central hole 26' large enough to allow the passage of flow-retaining head 10. In particular, central hole 26' is a circular hole and has a diameter larger than a maximum radial size of flow-retaining head 10, i.e. a diameter larger than the outer diameter of bush element 17.

Cylindrical box 21 of support 20 also comprises a plurality of rods 66' that extend from the face 24' of disc 24 that faces outwards opposite to disc 26, and are preferably angularly spaced apart at an angular distance from each other. Two series of radial elements 65' extend from rods 66' to support two bushings 45 that hold a hydraulic actuator unit 41. Hydraulic actuator 41 comprises a cylinder 43 and a piston, not shown, which slides within an actuation chamber of cylinder 43 together with a stem 44 that is co-axially connected with flow-retaining head 10. Cylinder 43 is integrally inserted within bushings 45, and is co-axial along with flow-retaining head 10 with discs 24,26.

Therefore, by operating the hydraulic actuator unit 41, i.e. by moving the piston and stem 44 within the chamber of cylinder 43, flow-retaining head 10 performs a stroke i.e. a sliding movement along axis 20' within the cage, in particular an approach stroke or sliding movement towards disc 26.

Figure 11:
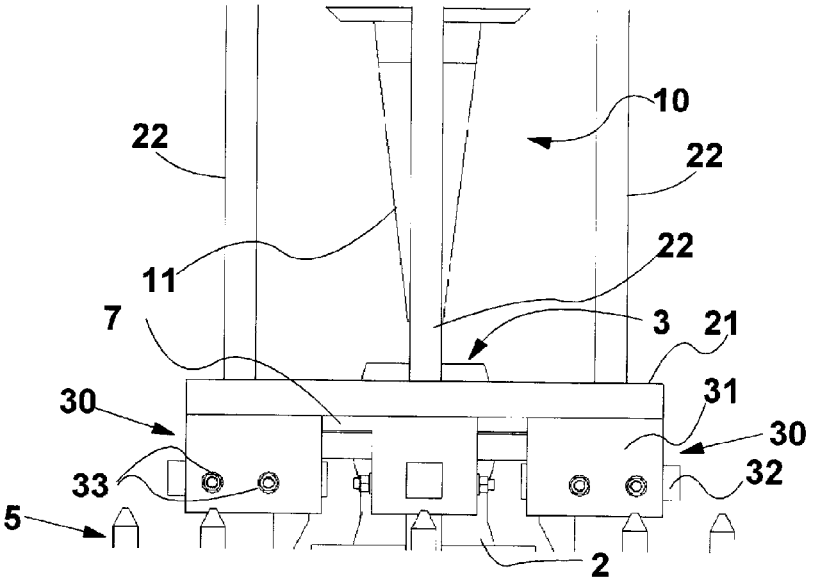
FIG. 11 is a partial elevation partial side view of the device of FIGS. 4 and 5, with the fastening means engaged with a flange proximate to the outlet mouth, before blocking the outflow.

Radial teeth 31 of fastening means 30 are slidingly arranged along axis 20' within respective housings defined by blocks 32, which are connected to plate 26 of support 20, and have inner engagement ends that are adapted to engage, according to an undercut engagement, with flange 7 proximate to outlet mouth 3, as FIGS. 8 and 11 show in detail. In an exemplary embodiment, not shown, teeth can be provided whose ends are adapted to engage by means of a clamp engagement with protruding portion or flange 7. Teeth 31 may have an external end that is adapted to be actuated by a ROV-type remotely operated vehicle that is suitable for underwater operation, in particular for undersea operations at high depth. As FIGS. 8 and 11 still show, teeth 31 have pins 33 that slidingly engage elongated holes 34 made within the blocks 32. A lock means, not shown, is also provided for locking/unlocking sliding pins 33 within respective elongated holes 34, which allow to lock/unlock sliding teeth 31 within the respective housings defined as 32, which teeth are also preferably adapted to be actuated by a ROV-type vehicle.

Figure 12:
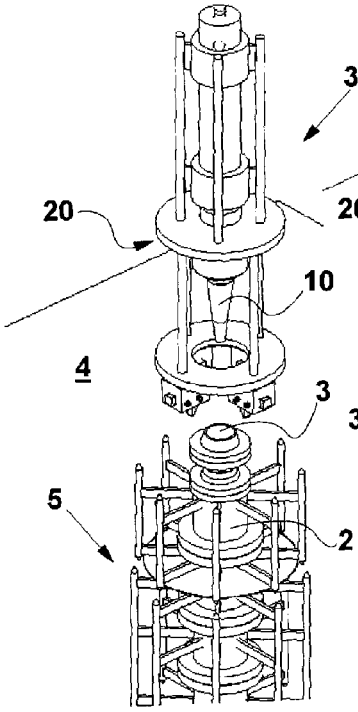
FIG. 12 is a perspective view of the device of FIGS. 4 and 5, and of a blowout preventer of an underwater well to be plugged before the fastening step.
Figure 13:
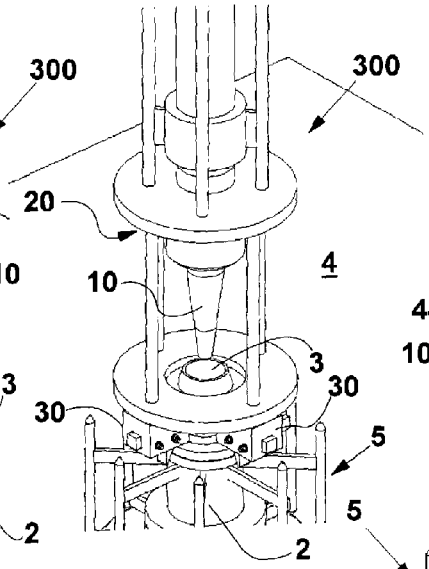
FIG. 13 is a perspective partial view of the device and of the BOP of FIG. 11, after reciprocal fastening and with the flow-retaining head at the manoeuvre position.
Figure 14:
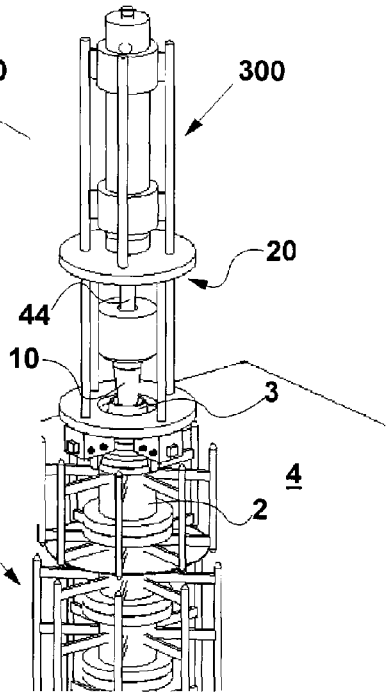
FIG. 14 is a perspective view of the device and of the BOP of FIGS. 11, 12 and 13, with the flow-retaining head at an intermediate position between the manoeuvre position and the retaining position.
Figure 15:
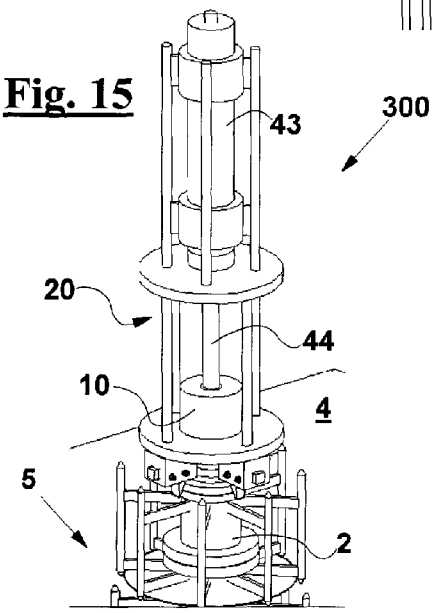
FIG. 15 is a perspective view of the device and of the BOP of FIGS. 11 to 14, with the flow-retaining head at the retaining position.

FIGS. 12 to 16 diagrammatically show the steps of a flow-retaining and closing operation of an outlet mouth 3 of a well that protrudes from a floor 4, by means of the device 300 according to the invention. The procedure, which comprises the steps as described below, may be used for any type of outlet mouth of a well delivering a pressurized fluid such as crude oil or natural gas. The procedure comprises a step of dipping device 300 to reach a proximity of outlet mouth 3, as FIG. 12 shows. Such step of dipping may be carried out by means of a conventional underwater device. For instance, at a high depth the underwater device may be an above mentioned ROV-type vehicle. A step is then provided of fastening device 300 to tubular extension 2 of the well, in particular, to flange 7 proximate to outlet mouth 3. For example, the fastening may be carried out by an undercut engagement, as shown in FIG. 11. During the fastening step, flow-retaining head 10 is located at a manoeuvre position 8, (FIGS. 1 and 2), i.e. at such a distance from outlet mouth 3 that it does not substantially receive any thrust force from the fluid escaping from the well. At the end of the fastening step, as shown in FIG. 13, flow-retaining head 10 is still located at manoeuvre position 8. As shown in FIG. 14, a step follows of sliding movement of flow-retaining head 10 along axis 20' of device 300, during which flow-retaining element 11 is introduced into tubular extension 2 of the well, up to reaching a retaining position 9 (FIGS. 1 and 2), as shown in FIG. 15.

Once the retaining position has been attained, the well can be plugged, i.e. definitively closed. As FIG. 16 shows, channel 55 may be brought into hydraulic connection with a feed pump 91 of a plugging fluid 93, which is arranged on a surface structure 90 of the well. For instance, plugging fluid 93 may be a mud. The plugging fluid is fed into tubular extension 2 by operating pump 91 and by opening valve 19, through a duct 92 arranged between the well and surface structure 90. Valve 19 prevents the fluid contained within tubular extension 2 of the well from flowing out before operating pump 91. When pump 91 is operated, plugging fluid 93 is supplied into tubular extension 2 of the well and compacted, at a pressure which depends upon the prevalence of pump 91. As shown in FIG. 7, a discharge channel 75 can be provided within flow-retaining head 10, which also has a connection duct 95' with the surface structure, and also has a shut-off valve 19'. In this case, in order to assist supplying the plugging fluid, it is possible to open and to keep open valve 19', so that the fluid 94 contained within tubular extension 2 is discharged and a passage is left free for the plugging fluid. In a subsequent phase of the injection, valve 19 may be closed to assist compaction of the plugging fluid within tubular extension 2. Once the compaction has been carried out, device 300 may be removed from the tubular extension of the well and withdrawn outside of the water body.

Figure 17:
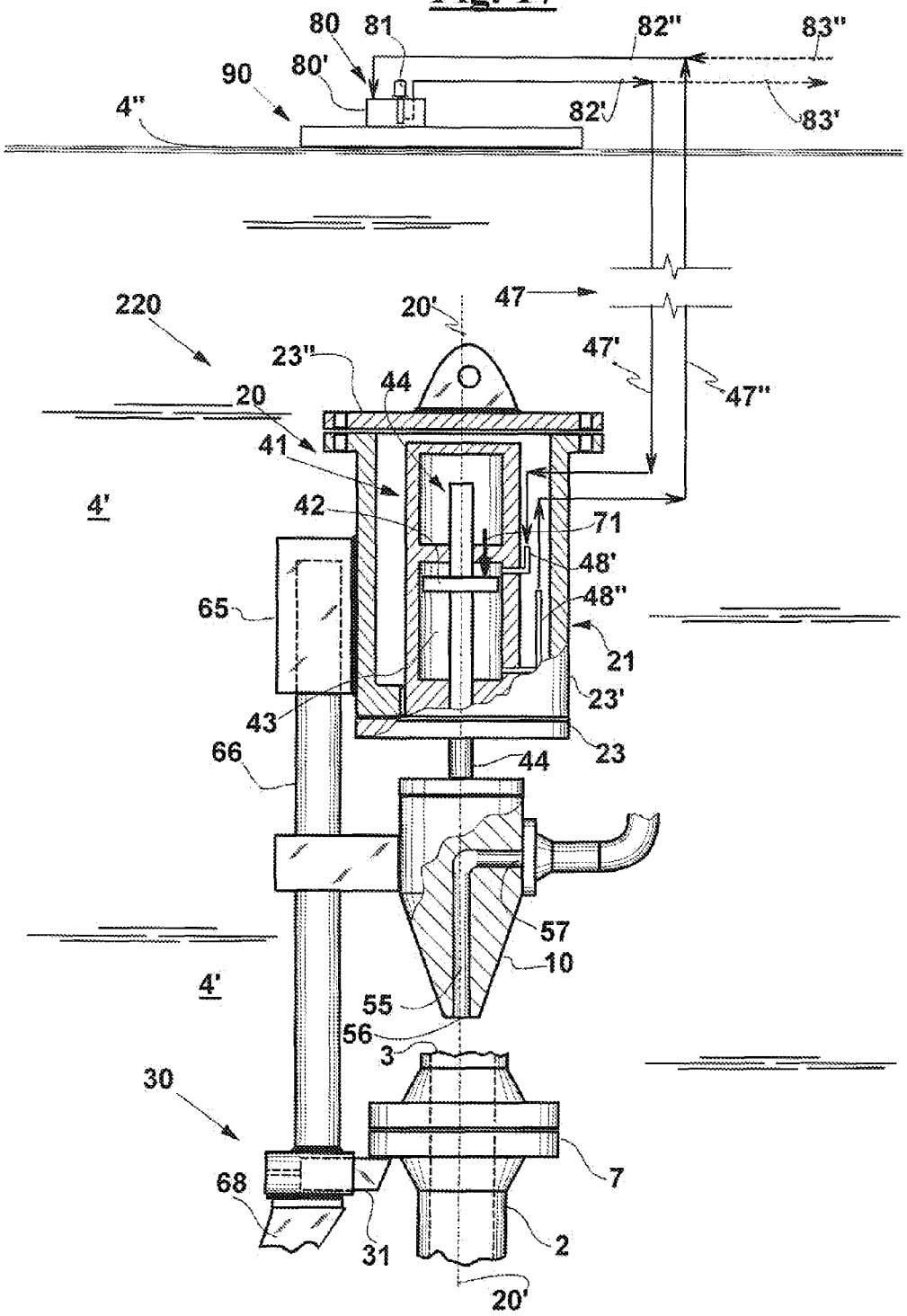
FIG. 17 diagrammatically shows an actuation circuit of a hydraulic means for bringing the flow-retaining head from the manoeuvre position to the retaining position.
Figure 17:
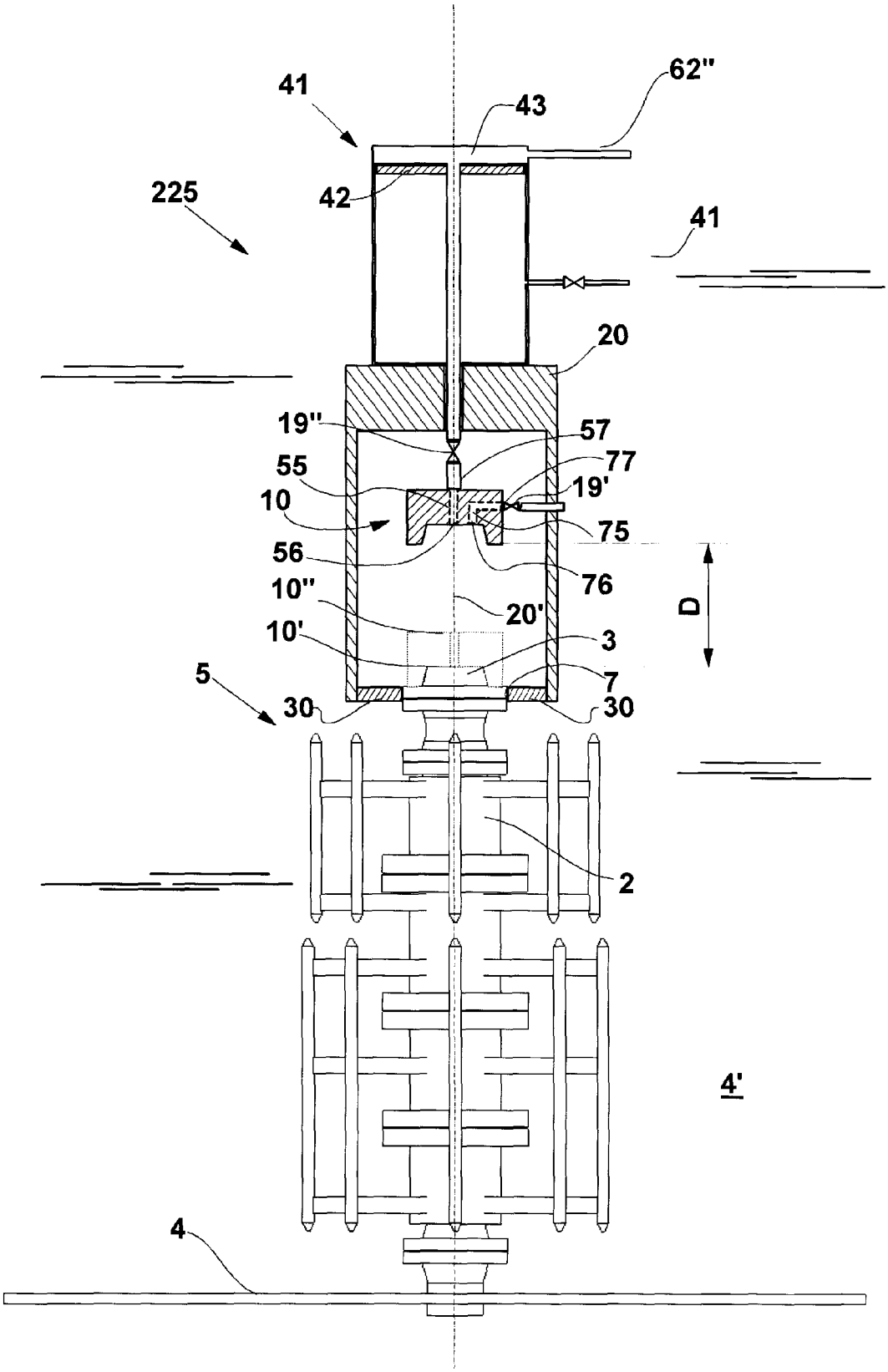

With reference to FIG. 17, a control circuit 47 is described which is a part of the hydraulic means for moving flow-retaining head 10 of a device 220 according to the invention. Circuit 47 comprises a pump means 81 that is adapted to provide a hydraulic fluid at a predetermined pressure. In particular, the hydraulic fluid may be a hydraulic oil taken by a pump 81 from a storage basin 80' of a hydraulic power unit 80 that is arranged on surface structure 90 of the well. Pump 81 is connected to a supply collector 82', and a return collector 82" is provided for returning the hydraulic fluid into storage basin 80. Advantageously, hydraulic power unit 80 is shared with other users of the well, which are diagrammatically indicated by branches 83' and 83" of supply collector 82' and of return collector 82", respectively. Circuit 47 comprises a supply branch 47' and a return branch 47" that connect supply collector 82' and return collector 82" respectively with connection elements 48' and 48" of actuation chamber 43. The hydraulic fluid delivered by pump 81 through supply collector 82' and through supply branch 47' acts on the upper surface of piston 42, so that piston 42, stem 44 and the flow-retaining head, can be displaced towards the tubular extension of the well, until retaining position 9 of flow-retaining head 10 is reached (FIGS. 1 and 2).

In another example, the hydraulic fluid may be a mud which results from drilling the well, which is normally available on an underwater well surface structure. Even in this case, power unit 80 for operating the fluid may be a distribution unit that is exploited by further users 83',83".

With reference to FIG. 17', a device 225 is described according to an exemplary embodiment of the invention wherein a hydraulic actuator unit 41 is provided which comprises an actuation piston 42 slidably arranged within an actuation chamber 43 and adapted to be supplied with a working fluid, In particular, a mud, through a connection or a duct 62". Device 225 is a shut-off valve which is adapted to connect duct 62" with channel 55 of flow-retaining head 10, so that the working fluid floods and pressurizes the well starting from outlet mouth 3. This way, feeding the working fluid into actuation chamber 43 while valve 19" is kept closed, a step is carried out of sliding movement of flow-retaining head 10 with respect to support 20 along slide axis 20' from manoeuvre position 8 to retaining position 9. During this step of sliding movement, the working fluid works as an actuation fluid. By opening valve 19", a subsequent step can be carried out of feeding the working fluid into the tubular extension, where the working fluid works as the plugging fluid.

Figure 18:
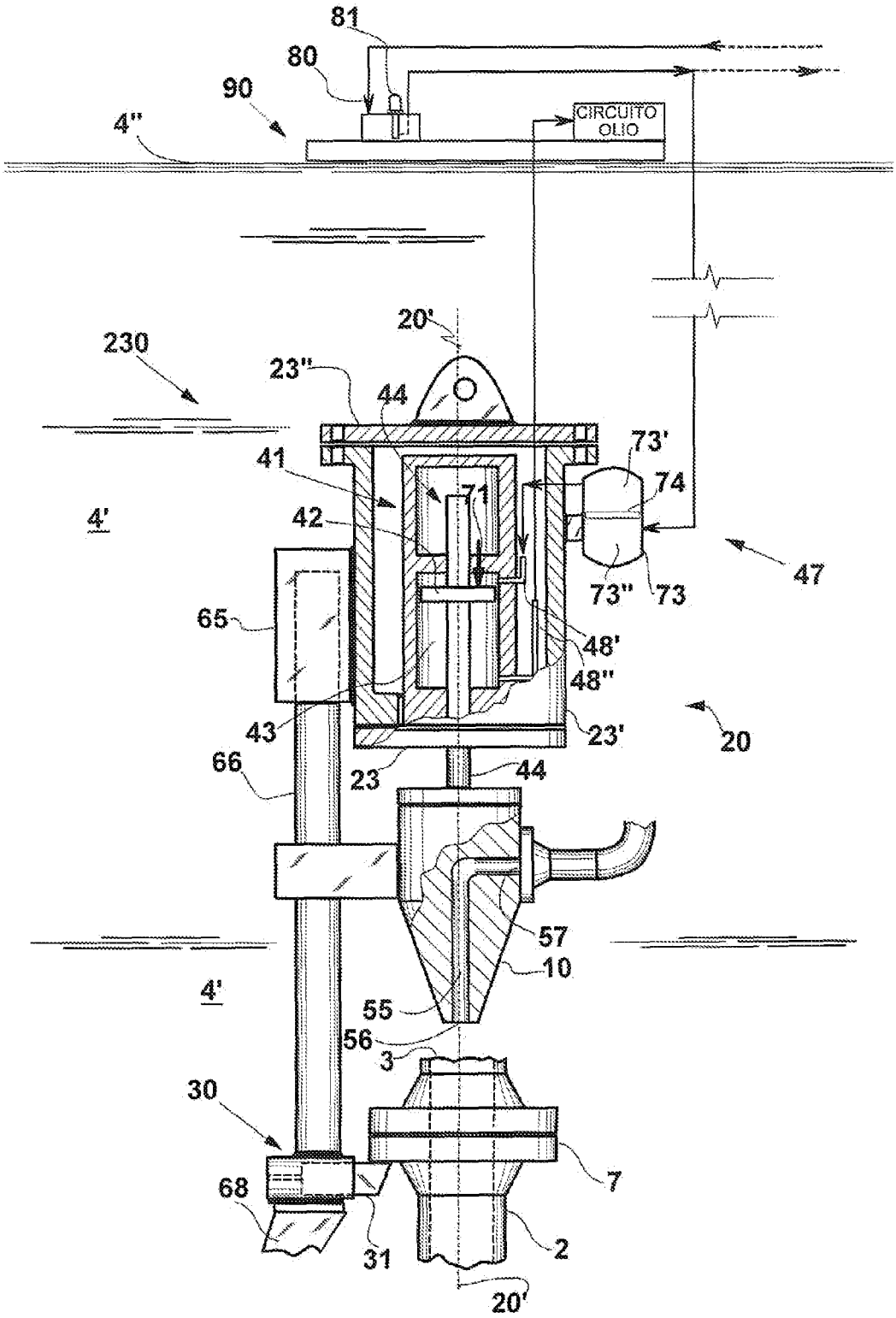
FIG. 18 diagrammatically shows an actuation circuit in alternative to the circuit of FIG. 17.

With reference to FIG. 18, a device is described 230 which is similar to the device 220 and in which control circuit 47 also comprises a compensation container 73 and a compensation element 74 movably arranged therein. Compensation element 74 defines, within compensation container 73, a primary room 73' that is hydraulically connected with the source 81 of an actuation fluid, and a secondary room 73" that is hydraulically connected with actuation chamber 43. In particular, the actuation fluid is a mud, whereas the fluid that is in hydraulic connection between primary room 73' of compensation container 73 and actuation chamber 43 may be a hydraulic oil, in order to avoid using the mud or another actuation fluid different from a hydraulic oil, within actuation chamber 43.

Figure 19:
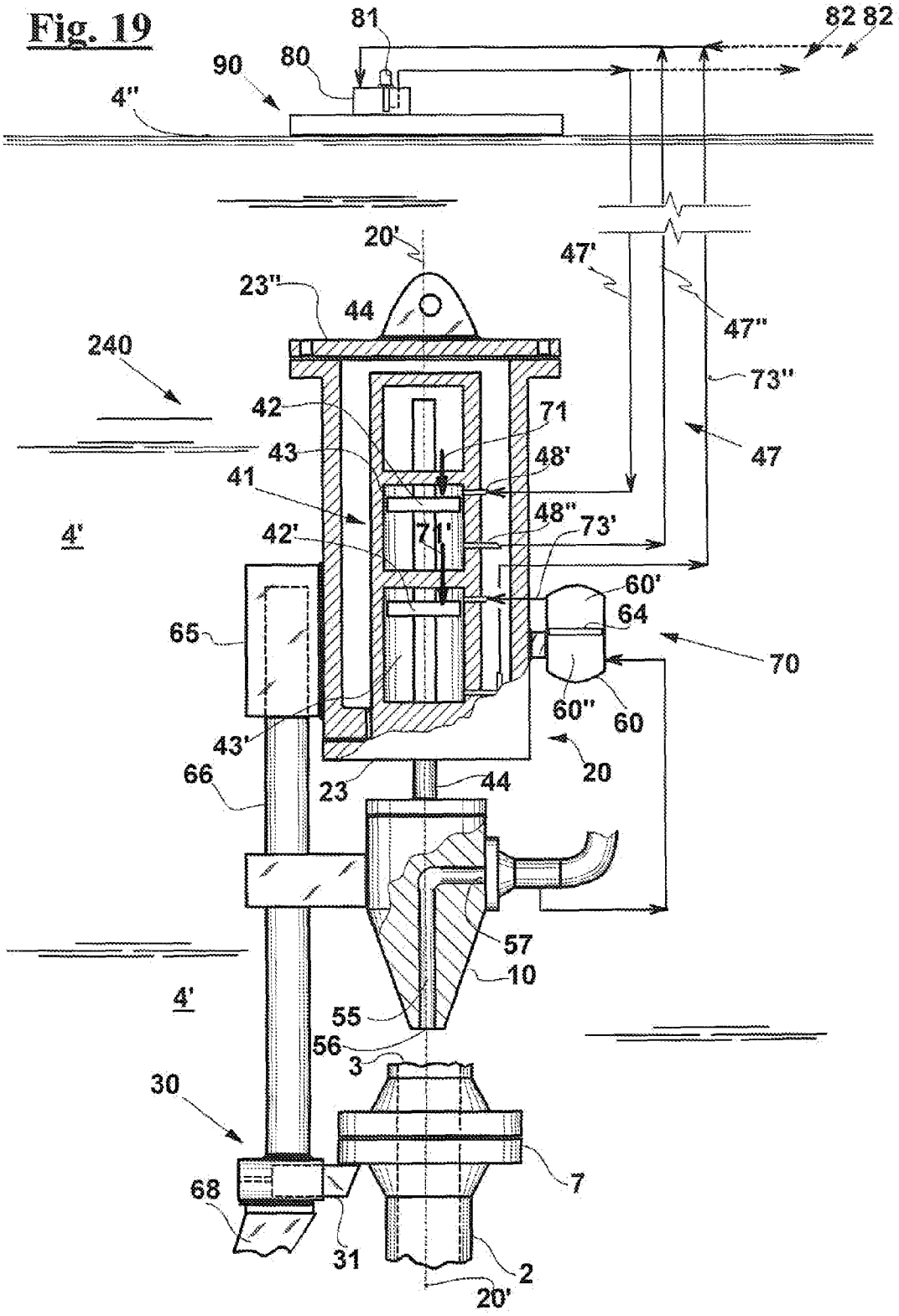
FIG. 19 diagrammatically shows an actuation circuit in alternative to the circuit of FIGS. 17 and 18, which takes advantage of the pressure of the well for reducing the pressure that is required for bringing the flow-retaining head to the retaining position.

With reference to FIG. 19, a device 240 is described in which the hydraulic means for moving flow-retaining head 10 comprises also a circuit 47, which is similar to the circuit shown in FIG. 17. The actuation means is also provided with a balancing circuit 70 that comprises a balancing chamber 60 in which a balancing element 64 is movably arranged which divides balancing chamber 60 into a primary recess 60' and a secondary recess 60". For example, movable balancing element 64 may be a membrane or a piston sliding within a longitudinal balancing chamber 60. Primary recess 60' is hydraulically connected with actuation chamber 43 inside support 20 through duct 73'. Primary recess 60', duct 73' and a second actuation chamber 43' contain a measured amount of an actuation fluid, for example of a hydraulic oil. Secondary recess 60" is hydraulically connected with tubular extension 2 of the well, preferably through channel 55 of flow-retaining head 10 during the sliding approach of head 10 to tubular extension 2. Movable element 64 can change the volume of primary chamber 60' responsive to the pressure inside secondary chamber 60", which depends upon the pressure that is established within tubular extension 2 of the well. The hydraulic oil 73' is then pushed into actuation chamber 43' maintaining on piston 42' a pressure that depends upon the pressure that is established within tubular extension 2. The balancing circuit also comprises a discharge duct 73" of the oil that is contained within actuation chamber 42', advantageously, into storage basin 80' of power unit 80.

Figures 20, 21, 22:
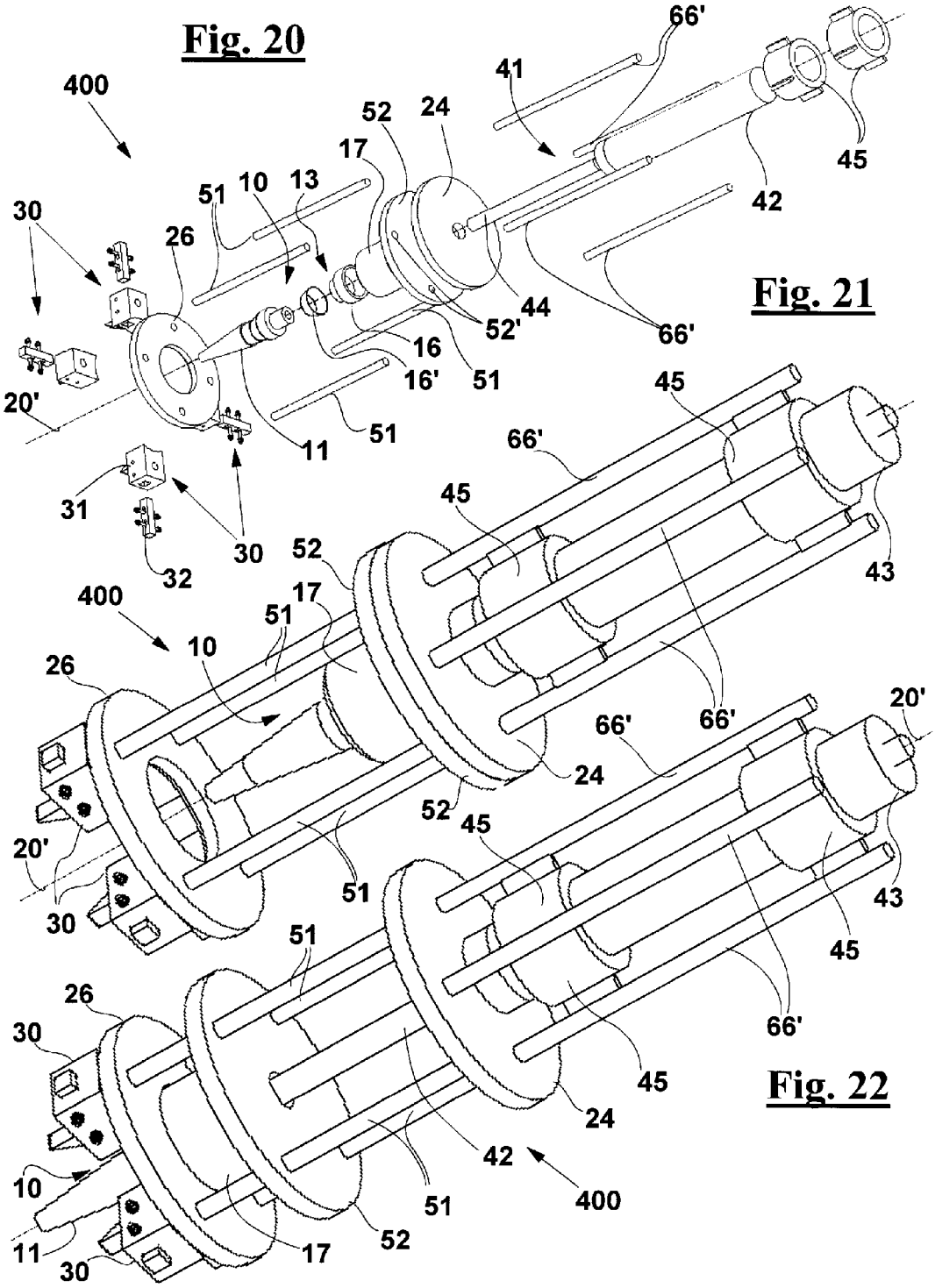
FIG. 20 is an exploded perspective view of a device in a second exemplary embodiment of the invention, wherein a lock means is provided for locking the flow-retaining head at the retaining position, comprising a movable plate element that can be fixed to guide elements of the support.
FIG. 21 is a perspective view of the device of FIG. 20, with the flow-retaining head in a rearward position, which substantially corresponds to the manoeuvre position.
FIG. 22 is a perspective view of the device of FIGS. 20 and 21, with the flow-retaining head in a forward position, which substantially corresponds to the retaining position.

FIGS. 20 to 22 show a device 400 according to another exemplary embodiment of the invention. Device 400 has the same features as device 300, as indicated by the reference numbers. Furthermore, a lock means is provided for keeping flow-retaining head 10 at the retaining position independently from the position and from the presence of hydraulic actuator unit 41, which in case of device 300 must instead maintain a pressurized condition in order to prevent the fluid from flowing out of outlet mouth 3. In particular, FIG. 20 is an exploded perspective view similar to the exploded view of FIG. 5, whereas FIGS. 21 and 22 are two prospective views in which the flow-retaining head is at a rearward position, corresponding in use to manoeuvre position 8 (FIGS. 1 and 2) and at a forward position, corresponding in use to retaining position 9 (FIGS. 1 and 2), respectively.

In device 400, the lock means comprises four longitudinal guide elements 51 that are similar to spacer elements 22 of device 300, i.e. they are arranged between disc 26 and disc 24. The lock means also comprises a movable plate 52 formed as a round disc, which may have the same diameter of disc 24. Movable disc 52 is integral to flow-retaining head 10, in particular to bush element 17. Movable disc 52 has longitudinal through holes 52' through which movable element 52 and longitudinal guide elements 51 slidingly engage with respect to each other. Once the sliding approach has been carried out, movable plate 52 may be locked with respect to longitudinal guide elements 51, in order to prevent flow-retaining head 10 from leaving the retaining position under the pressure of the fluid in tubular extension 2 of the well, while no resistant force acts upon it. For example, movable plate 52 may be welded to guide elements 51 at the holes 52'. In such conditions, longitudinal guide elements 51 can be cut and piston 42 can be cut as well, or can be removed from flow-retaining head 10. Flow-retaining head 10 remains then at retaining position 9 within tubular extension 2, while hydraulic actuation unit 41 may be removed and re-used.

Figure 23:
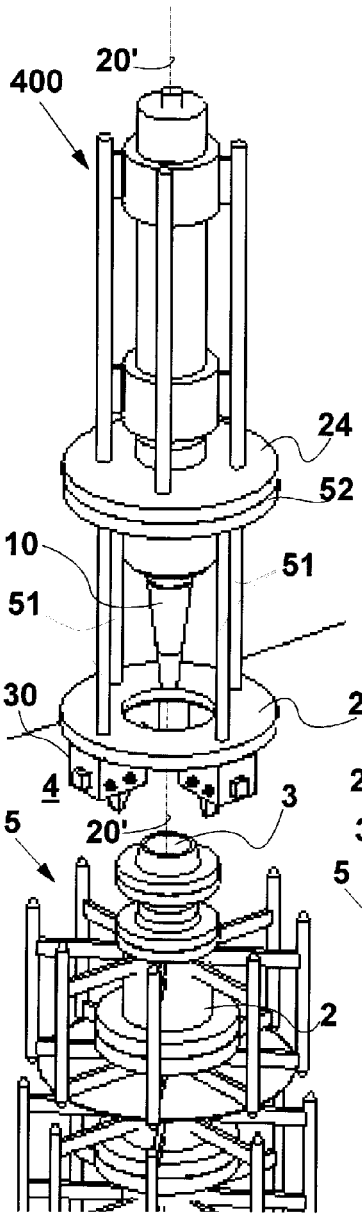
FIG. 23 is a perspective view of the device of FIGS. 20 to 22, and of a blowout preventer of an underwater well to be plugged, before the fastening step.
Figure 24:
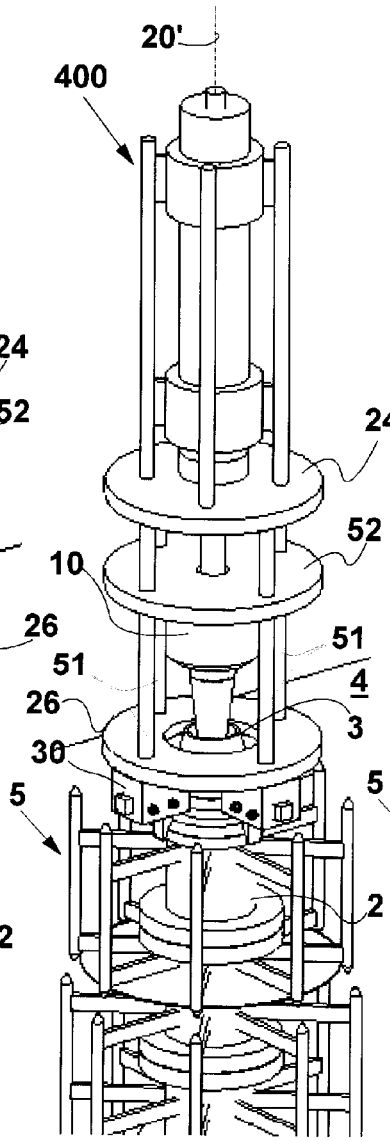
FIG. 24 is a perspective view of the device and of the BOP of FIG. 23, with the flow-retaining head in an intermediate position between the manoeuvre position and the retaining position.
Figure 25:
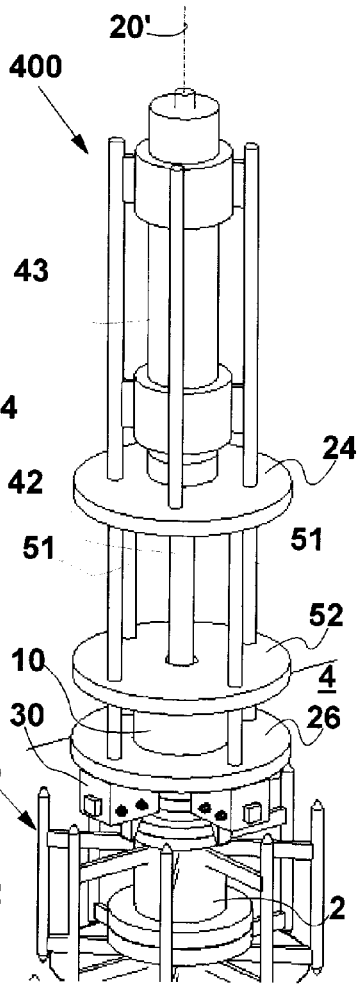
FIG. 25 is a perspective view of the device and of the BOP of FIGS. 23 and 24, with the flow-retaining head at the retaining position.

In analogy with FIGS. 12, 14 and 15, FIGS. 23 to 25 show diagrammatically the steps of an operation containing and plugging outlet mouth 3 of a well with device 400. FIG. 23 shows device 400 during a step of dipping it down to outlet mouth 3, which is followed by a step of fastening it to flange 7 and a step of sliding movement of flow-retaining head 10 along axis 20' of device 400, which is shown in a intermediate condition in FIG. 24 and in its final condition in FIG. 25, in which flow-retaining head 10 is at a retaining position. Even in this case, it is possible to carry out a step of plugging tubular extension 2 of the well by injecting or compacting the plugging fluid into tubular extension 2, according to the procedure described above with reference to FIG. 16. In this case the flow-retaining head may also be left at the retaining position, with disc 26 integral to uprights 51 and with disc 52 welded in use to a lower cut-away portion of uprights 51, by withdrawing the remaining part of device 400 outside of the water body.

Figure 26:
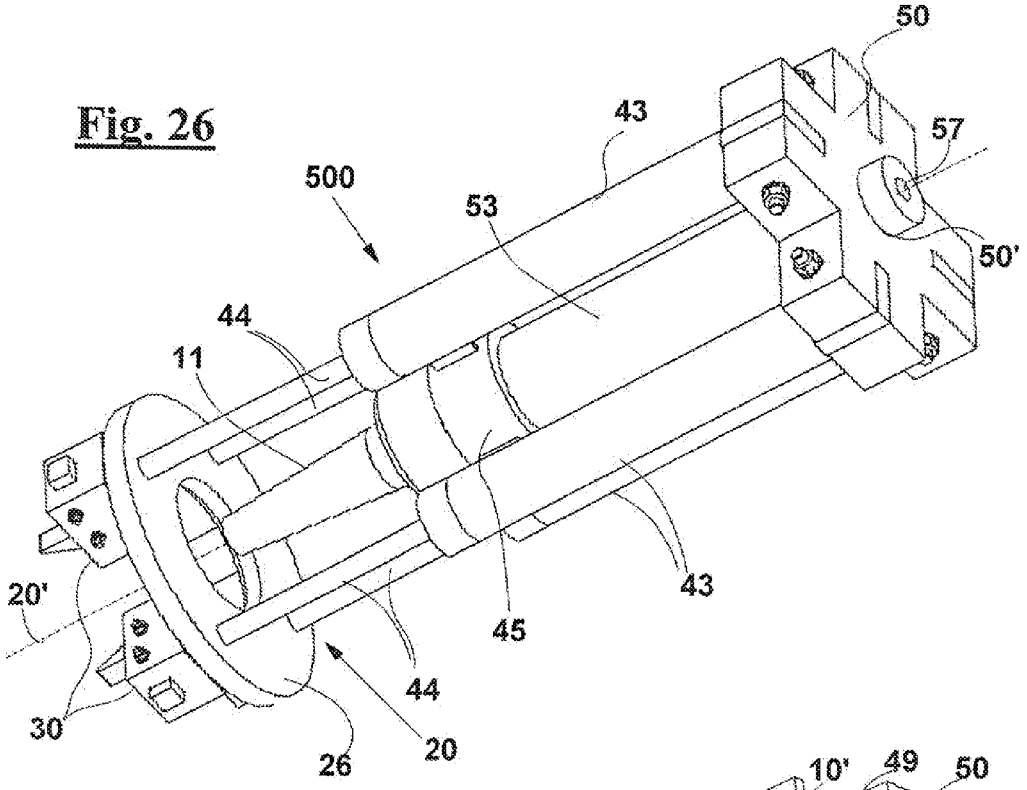
FIG. 26 is a perspective view of a device in a further exemplary embodiment of the invention, in which the means for carrying out the sliding movement of the flow-retaining head comprises four hydraulic actuators comprising a piston and a cylindrical chamber that are arranged about the slide axis, with the pistons integral to the support and the actuation chamber integral to the flow-retaining head.
Figure 27:
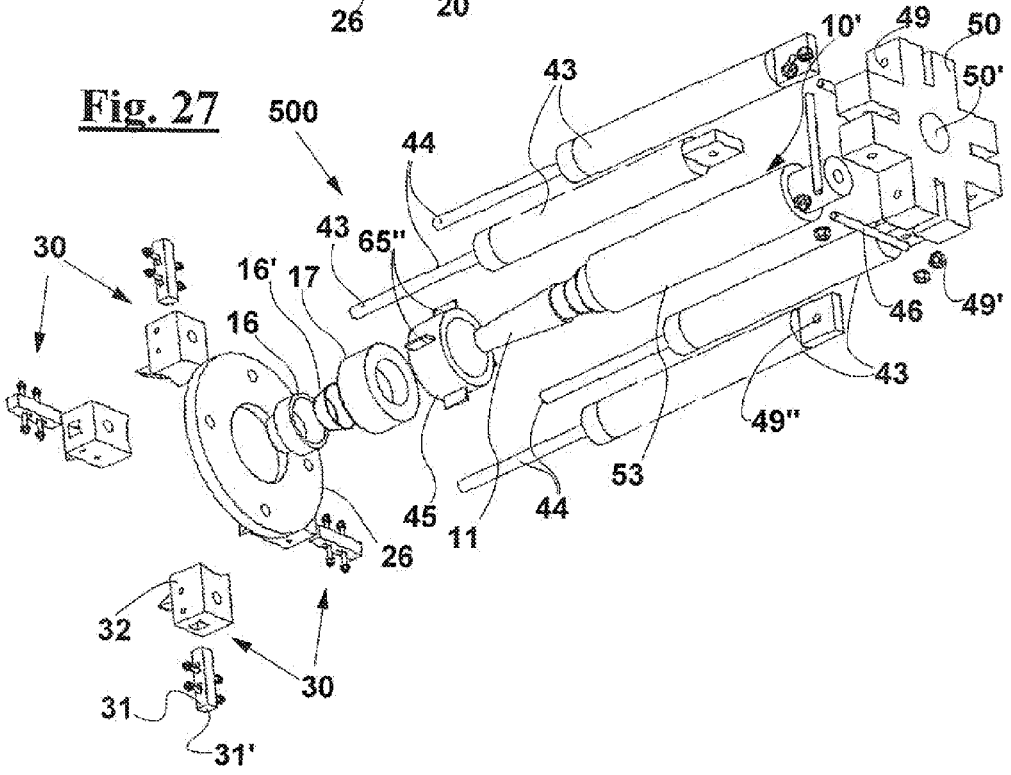
FIG. 27 is an exploded perspective view of the device of FIG. 26.

FIGS. 26 and 27 show a device 500 according to an exemplary embodiment of the invention. Device 400 has the same features as device 200, as indicated by the reference numbers. For causing flow-retaining head 10 slide with respect to the support, i.e. with respect to plate 26, device 500 has a plurality of hydraulic actuators 41, for example four actuators. Such actuators comprise cylinders 43 and pistons provided with stems 44, each slidingly arranged within cylinder 43. An actuation means, not shown, is also provided for moving pistons 42 with respect to cylinder 43 between a rearward position and an extended position. Cylindrical chambers 43 and the pistons provided with stems 44 are integral with flow-retaining head 10' and with support 20, respectively.

In particular, cylinders 43 have respective ends, opposite to the ends from which stems 44 protrude, which are connected to each other by a cross element 50. Cylinders 43 are connected to cross element 50 by respective pins 46, whose end portions engage into respective couples of holes 49 that are made on respective arms of cross element 50, and that are connected to holes 49 by screws 49'. Cylinders 43 have flat end portions where holes 49" are made to create a rotatable connection about respective pins 46. Actuator units 41 are arranged parallel to one another, with the free end of stems 42 connected to circular disc 26.

Figure 28:
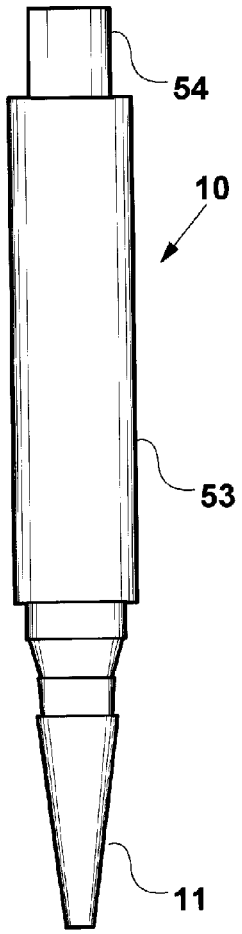
FIG. 28 is an elevational side view of a flow-retaining element of the flow-retaining head of the device shown in FIGS. 26 and 27.
Figure 29:
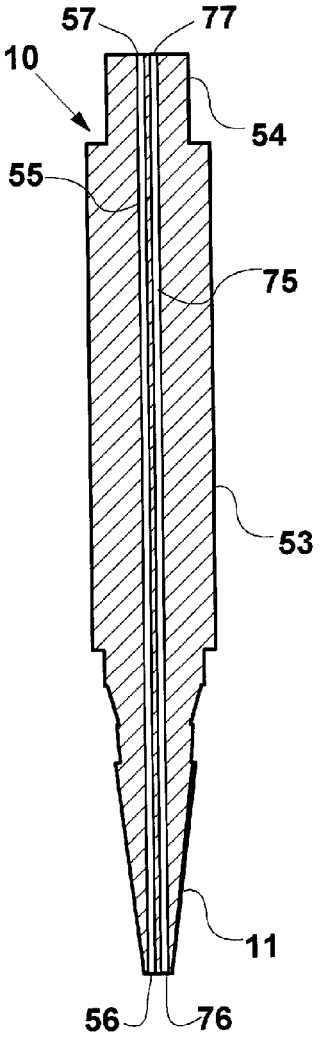
FIG. 29 is a cross sectional view of the detail of FIG. 28.

Therefore, by operating the actuation means and bringing hydraulic actuators 41 from the extended position to the rearward position, flow-retaining head 10 carries out the sliding approach to disc 26 i.e., in use, flow-retaining head 10 approaches to outlet mouth 3;

FIGS. 28 and 29 show more in detail flow-retaining head 10 of device 500, which comprises flow-retaining element 11 and the preferably cylindrical elongated tail portion or extension 53. Extension 53 ends with a rear portion 54 that has a cross section smaller with respect to extension 53. Rear portion 54 is adapted to be introduced into a through hole 50' of cross element 50, as described above. Flow-retaining head 10 of device 500 is connected to cylinders 43 by means of a bush 45 integral to extension 53, and has respective wings 65" for connecting cylinders 43.

In the sectional view of FIG. 29, channels 55 are shown which extend within elongated flow-retaining element 10 between passage ports 56 and 57, and a further discharge channel 75 is also shown that extends between passage ports 76 and 77. In the exemplary embodiment shown herein, both longitudinal channels 55 and 75 are substantially parallel to the longitudinal axis of elongated flow-retaining element 10, and passage ports 76 and 77 are arranged proximate to passage ports 56 and 57, respectively. Upper passage ports 57 and 77 of channels 55 and 75, respectively, can be reached through central hole 50' of cross element 50, behind device 500.

Figure 30:
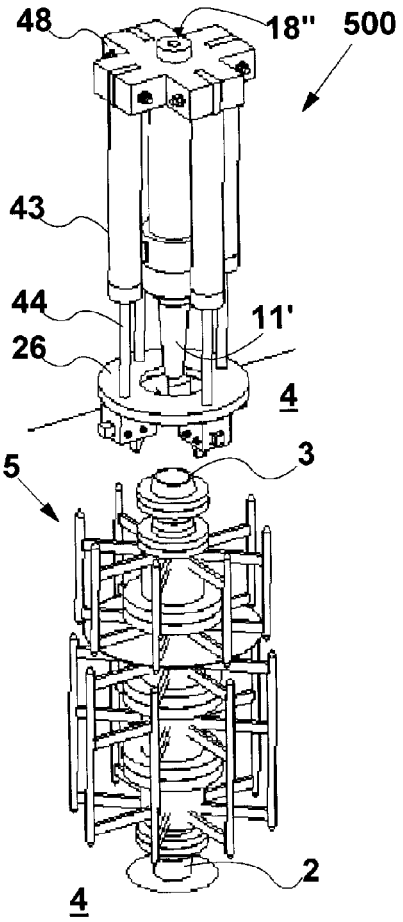
FIG. 30 is a perspective view of the device of FIGS. 26 and 27, and of a blowout preventer of an underwater well to be plugged, before the fastening.
Figure 31:
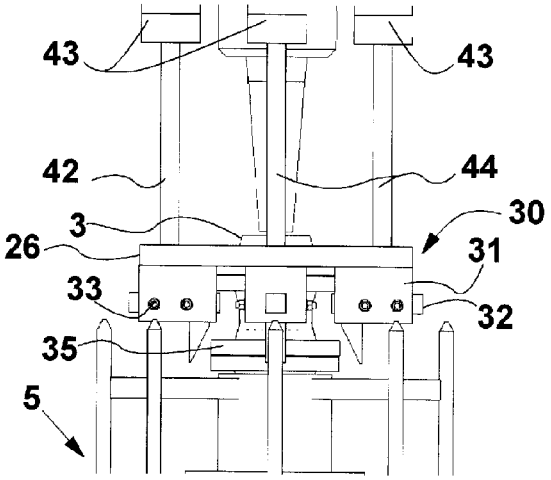
FIG. 31 is a detailed view of the device and of the well of FIG. 30, with the fastening means engaged with the tubular extension of the well, at a manoeuvre position.
Figure 32:
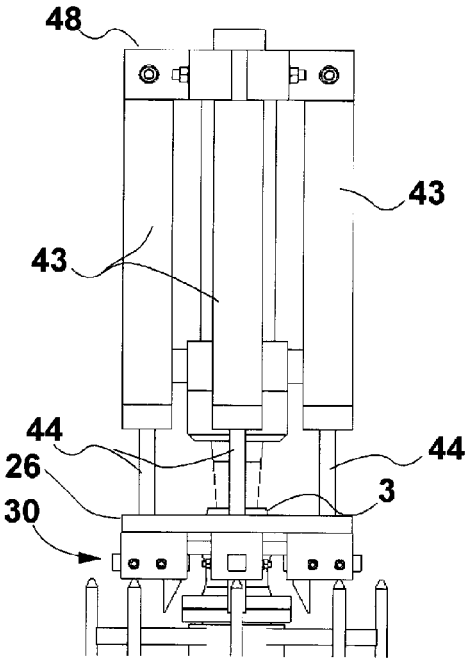
FIG. 32 is a detailed view of the device and of the well of FIG. 30, with the fastening means at an intermediate position between the manoeuvre position and a retaining position.
Figure 33:
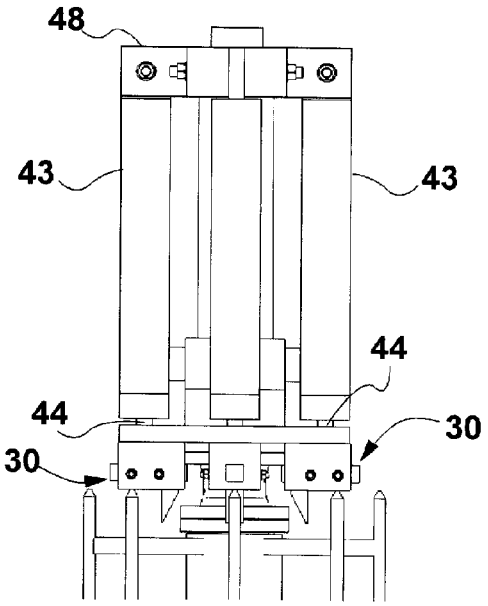
FIG. 33 is a detailed view of the device and of the well of FIG. 30, with the fastening means engaged with the tubular extension of the well, at the retaining position.

FIGS. 30 to 33 show diagrammatically the flow retaining and plugging steps of an outlet mouth 3 of a BOP device 5 that protrudes from a floor 4, by device 500 according to the invention. The procedure, which comprises the steps described below, may be used for any type of outlet mouth of a well of a pressurized fluid such as crude oil or natural gas. The procedure comprises a step of dipping device 500 down to a proximity of outlet mouth 3 of the well, as FIG. 30 shows. A step follows of fastening device 500 to tubular extension 2 by fastening means 30, as described above for devices 300 and 400. During the fastening step, flow-retaining head 10 is located at the manoeuvre position, in other words it is located at such a distance from outlet mouth 3 that is does not substantially receive any thrust force from the fluid being discharged. At the end of the step of fastening, as shown in FIG. 31, flow-retaining head 10 is still located at the manoeuvre position. As shown in FIG. 32, a step follows of causing flow-retaining head 10 to slide along axis 20' of device 400, during which flow-retaining element 11 is introduced into tubular extension 2 of the well, until a retaining position is attained, as shown in FIG. 33.

After reaching the retaining position, the well can be plugged, i.e. definitively closed, according to the procedure described with reference to FIG. 16.

Figure 34:
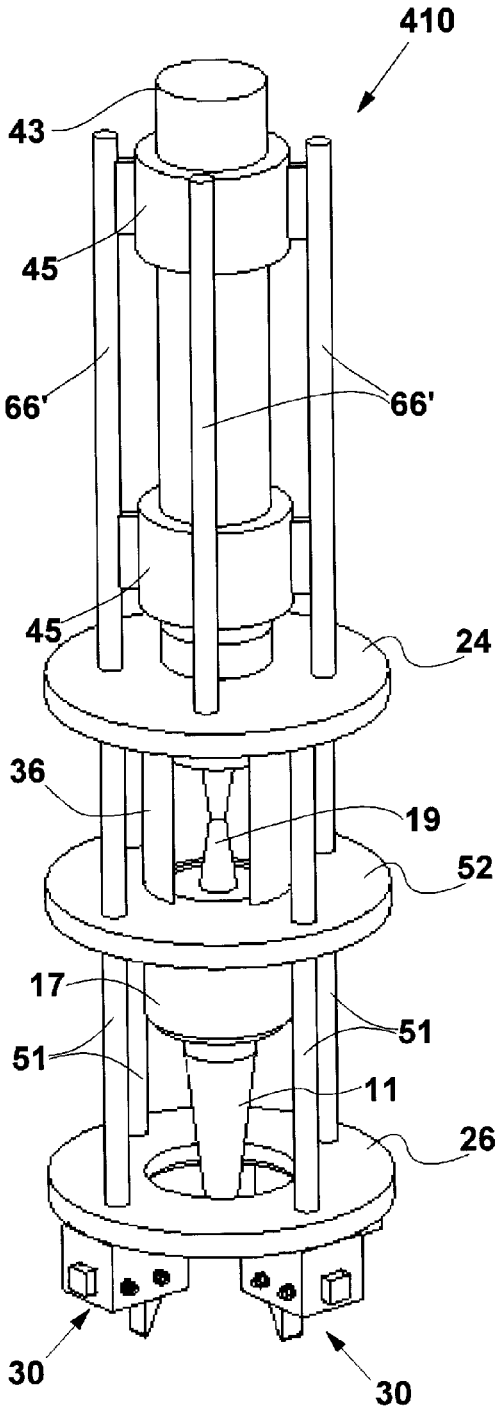
FIG. 34 is a perspective view of a device according to a further exemplary embodiment of the invention, wherein a valve is provided which is hydraulically connected with the channel of the flow-retaining head, wherein the flow-retaining head is at a rearward position, which substantially corresponds to the manoeuvre position.
Figure 35:
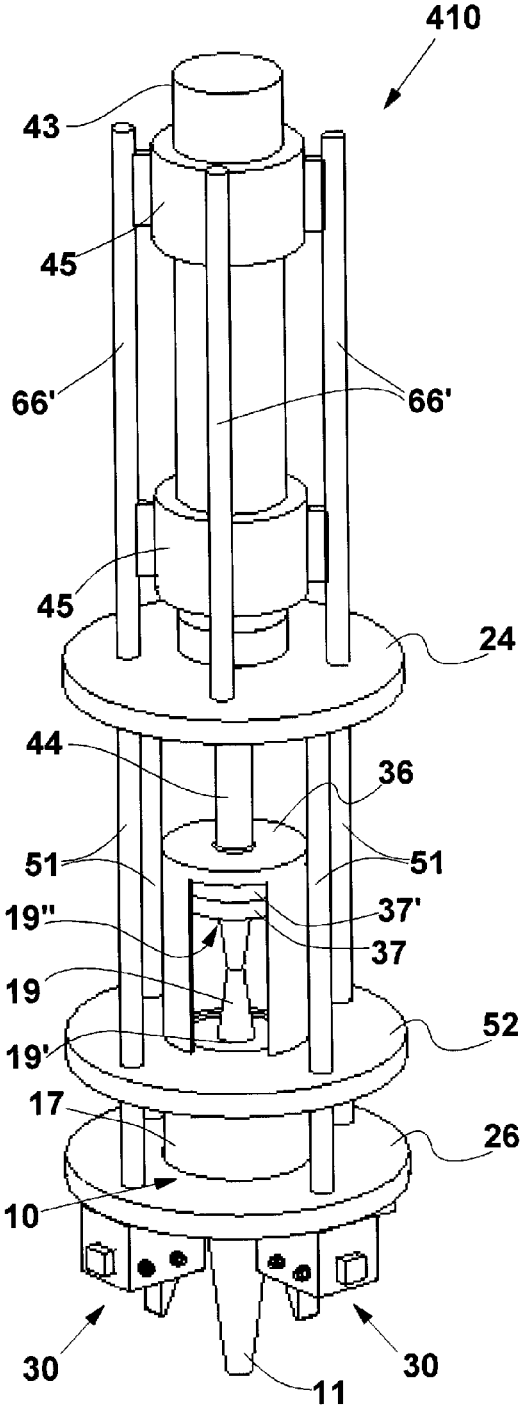
FIG. 35 is a perspective view of the device of FIG. 34, with the flow-retaining head in a forward position, which substantially corresponds to the retaining position.
Figure 36:
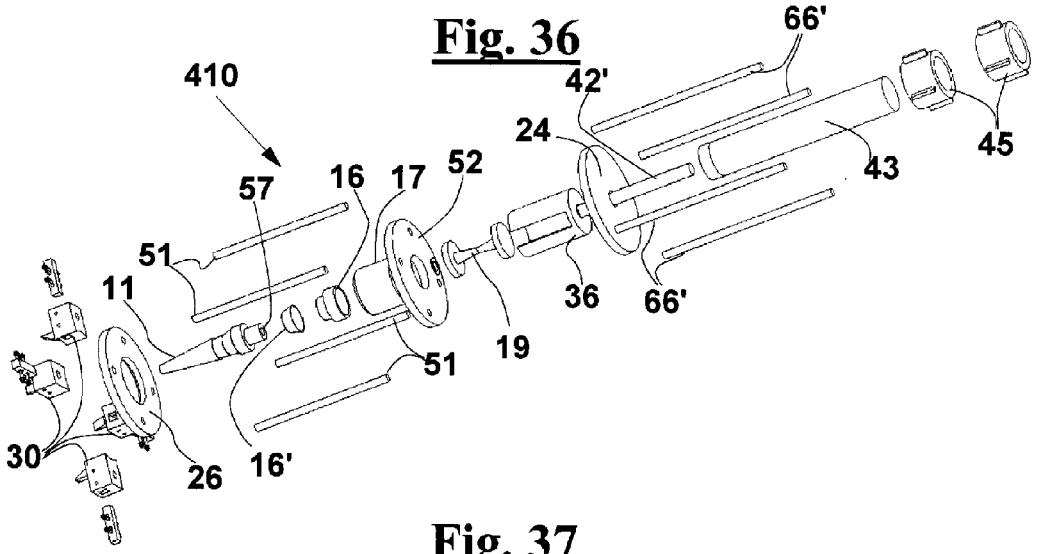
FIG. 36 is an exploded perspective view of the device of FIGS. 34 and 32.
Figure 37:
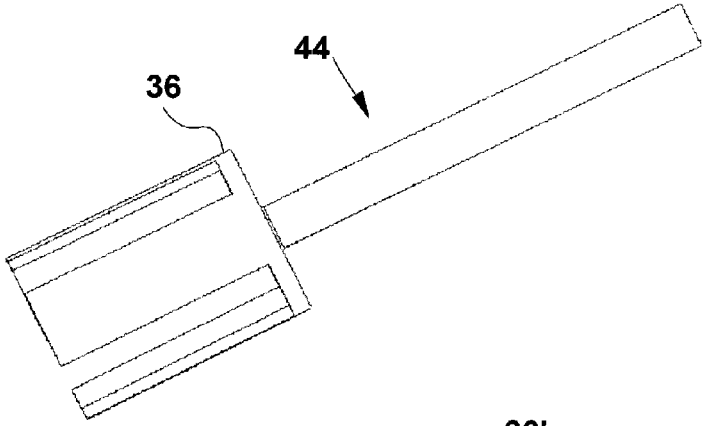
FIG. 37 is an elevational side view of a stem of the hydraulic actuator of the device of FIGS. 34 to 36.

FIGS. 34, 35 and 36 show a device 410 according to a further exemplary embodiment of the invention, which has the same features as device 400 of FIGS. 20-25, where stem 44 has a hollow end portion, i.e. a cup portion 36, shown more in detail in FIG. 37, which abuts against movable element 52. Cup portion 36 has an inner size large enough to contain shut-off valve 19. Shut-off valve 19 has an inlet port 19' that is hydraulically connected with upper passage port 57 (FIGS. 6, 7 and 35) of channel 55 of flow-retaining head 10. An outlet port 19" of associated valve 19 is available for connecting a water body surface duct. Cup portion 36 allows moving the flow-retaining head from a withdrawn position of FIG. 34, i.e. from manoeuvre position 8 (FIGS. 1 and 2), to a forward position 29, i.e. to retaining position 9 (FIGS. 1 and 2), without exerting significant axial loads on the valve.

Figure 38:
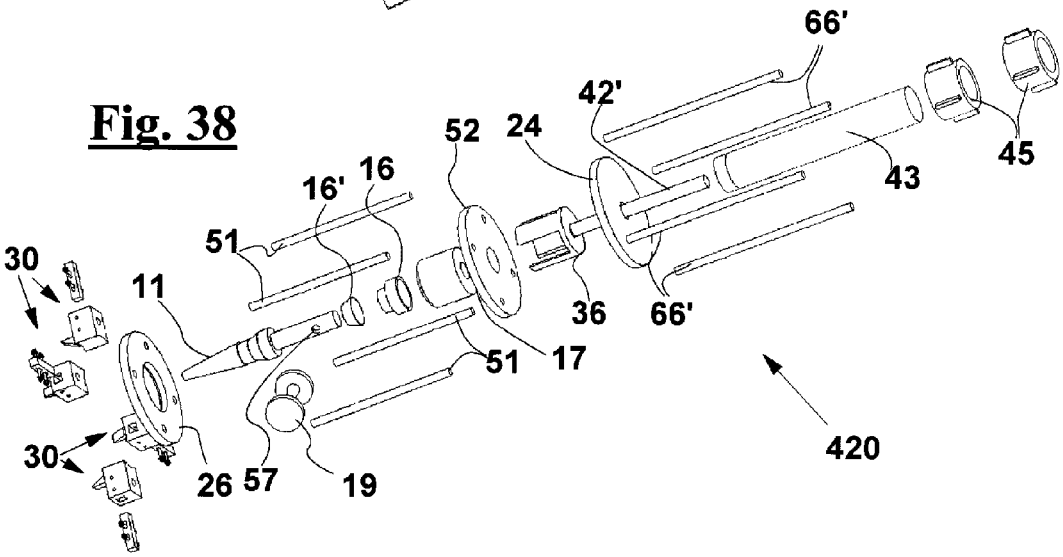
FIG. 38 is an exploded perspective view of a device according to a further exemplary embodiment of the invention, in which the valve is transversally arranged with respect to the longitudinal axis of the device.
Figure 39:
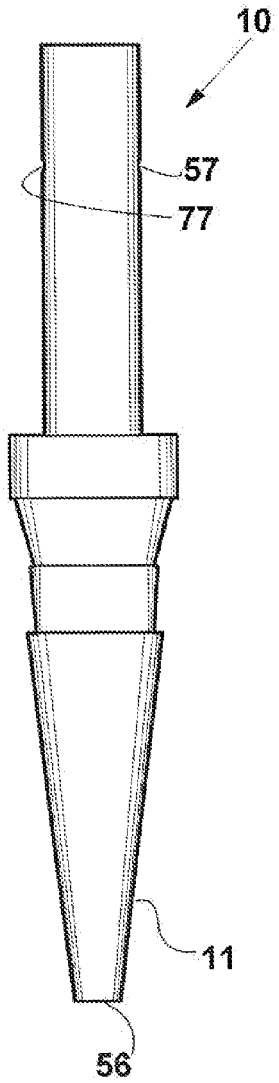
FIG. 39 is a cross sectional view of a flow-retaining element of the device of FIG. 38.
Figure 40:
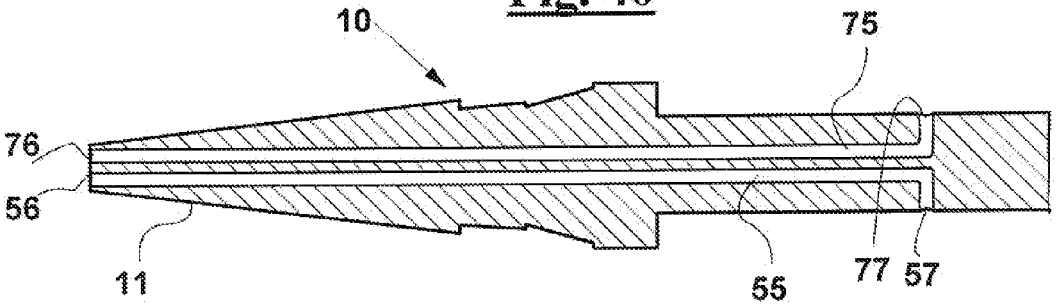
FIG. 40 is a cross sectional view of the detail of FIG. 39.

FIG. 38 is an exploded view of a device 420 according to the invention, which has the same features as device 410, except that shut-off valve 19 is not arranged along axis 20' but it is arranged transversally with respect to such axis. As shown in FIGS. 39 and 40, upper ports 57 and 77 of channels 55 and 75 are made in a side surface of flow-retaining head 10, like what is shown in FIG. 2.

Figure 41:
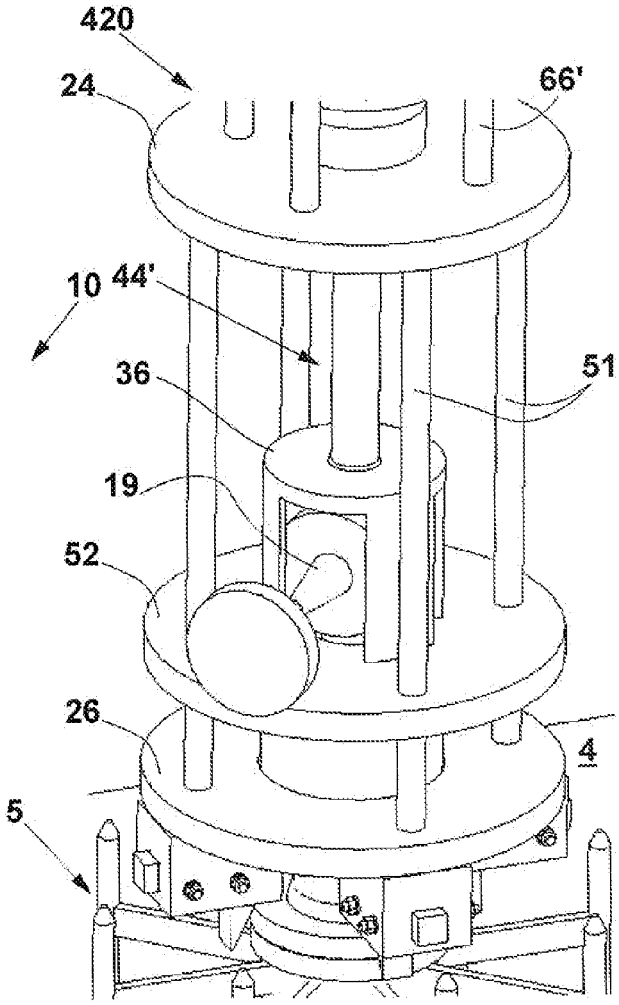
FIG. 41 is a perspective detailed view of the device of FIG. 38.

FIG. 41 is a partial perspective view of device 420 of FIG. 34.

Figure 42:
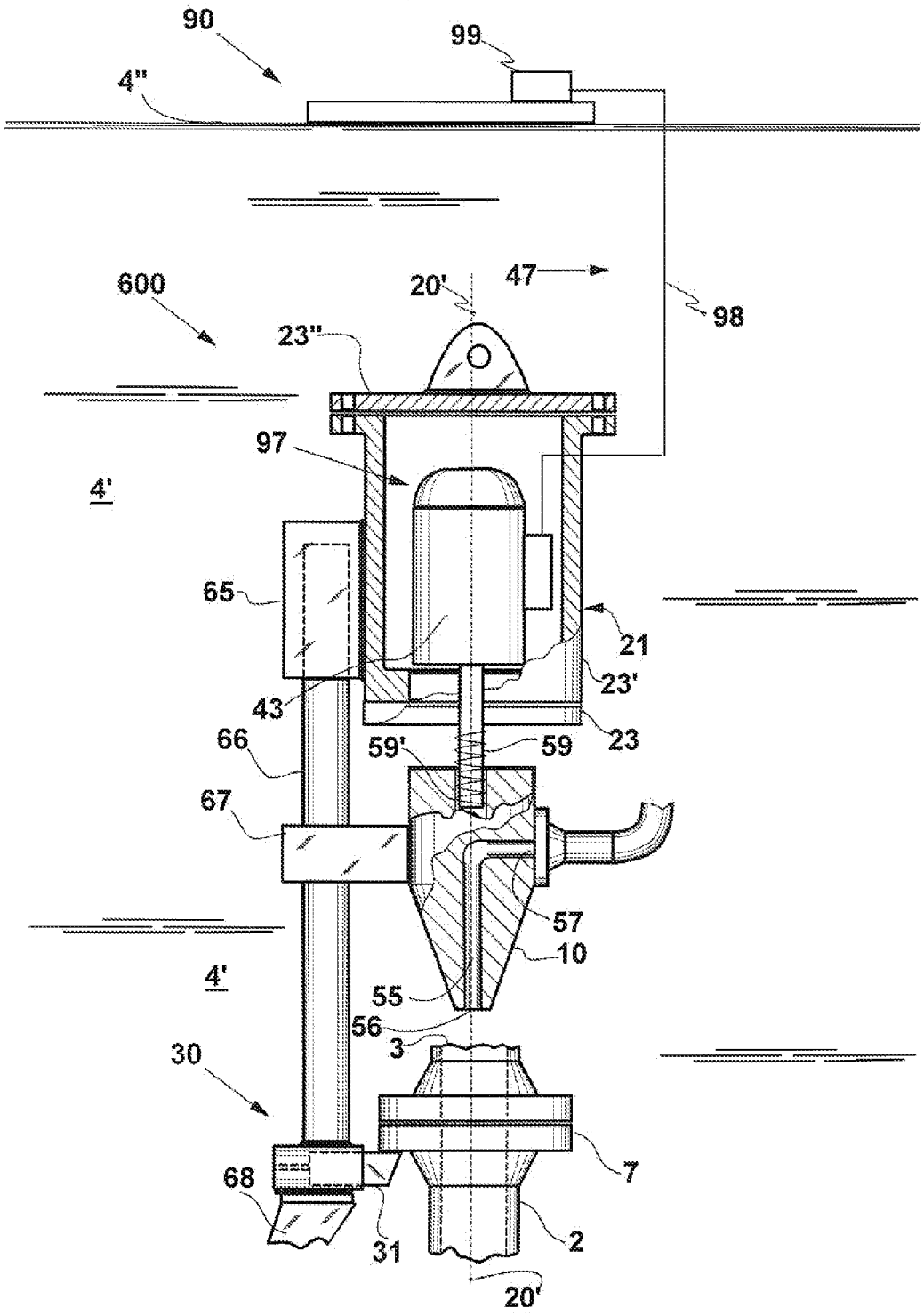
FIG. 42 shows a device according to an exemplary embodiment in which the actuation means of the flow-retaining head comprises an electric motor and a worm screw.

With reference to FIG. 42, a device 600 is described according to an exemplary embodiment of the invention in which the actuation means of flow-retaining head 10 comprises an electric motor 97 that is suitable for underwater installation. In particular, electric motor 97 is enclosed by support 20 which may have the shape of a cylindrical box, as described above with reference to FIGS. 2 and 3. The electric motor is electrically supplied through a conductive element 98 that is connected with a power panel 99 arranged on surface structure 90. In particular, the actuation means also comprises a worm screw 59 that is operated by electric motor 97 and that protrudes from support box 20, and is inserted within a nut screw 59' defined by flow-retaining head 10. Flow-retaining head 10, as in the case of device 200 of FIG. 2, is slidingly guided with respect to uprights 66 by radial elements 67 provided with through holes 67'. Therefore, by operating electric motor 97, rotating worm screw 59 causes a translation movement of flow-retaining head 10, in particular a downward sliding movement until it engages outlet mouth 3 and tubular extension 2 in a retaining portion.

The foregoing description of specific exemplary embodiments of the device according to the invention, and of its mode of use, will so fully reveal the invention according to the conceptual point of view, so that others, by applying current knowledge, will be able to modify and/or adapt for various applications such specific embodiment without further research and without parting from the invention, and it is therefore to be understood that such adaptations and modifications will have to be considered as equivalent to the specific embodiment. The means and the materials to perform the different functions described herein could have a different nature without, for this reason, departing from the field of the invention. It is to be understood that the phraseology or terminology that is employed herein is for the purpose of description and not of limitation.

The invention claimed is:

1. An underwater flow retaining device for retaining and blocking the outflow of a pressurized fluid from an outlet mouth of a tubular extension of an underwater well, said device comprising:

a flow-retaining head that is adapted to engage with said outlet mouth preventing said pressurized fluid from flowing out of said tubular extension, said flow-retaining head having a lower portion that faces said outlet mouth and an upper portion opposite to said lower portion;

a support of said flow-retaining head;

a fastening mechanism for fastening said support to said tubular extension;

an actuator for carrying out a sliding movement of said flow-retaining head with respect to said support along a slide axis of said support towards said fastening mechanism when said support is fixed to said tubular extension by said fastening mechanism, between:

a maneuver position, in which said flow-retaining head is at a predetermined distance from said outlet mouth, and said fastening mechanism is fixed to said tubular extension, and a retaining position, in which said flow-retaining head engages said outlet mouth, said distance of said maneuver position selected in such a way that said support is fixed to said tubular extension by said fastening mechanism while said flow-retaining head is still at a position where it is not affected by said outflow of said pressurized fluid, a channel that extends within said flow-retaining head between a lower passage port that is made at said lower portion and an upper passage port that is made at said upper portion, wherein a feed assembly is provided for feeding a plugging fluid, said feed assembly comprising a feed duct that has a first end hydraulically connected with said upper passage port of said channel of said flow-retaining head, and a second end of said feed duct equipped with a fastening mechanism for fastening to a duct or to a feed means of said plugging fluid, in such a way that a plugging fluid can be fed into said tubular extension of the well through said lower passage port to plug said tubular extension by hardening of said plugging fluid.

2. A device according to claim 1, wherein a discharge channel is provided, which extends within said flow-retaining head, between a lower discharge port, which is made at said lower portion, and an upper discharge port, which is made at said upper portion.

3. A device according to claim 2, wherein said portion of said piston, which extends out of said actuation chamber, comprises a hollow end portion that is adapted to contain said shut-off valve, said hollow end portion abutting against said movable element, and said feed duct comprises a passageway selected from the group consisting of:

a passageway through said actuation piston and said actuation chamber; and a passageway made transversally with respect to said actuation piston.

4. A device according to claim 1, comprising a shut-off valve, in particular said shut-off valve arranged proximate to the flow-retaining head with an inlet port connected to said upper passage port of said channel.

5. A device according to claim 1, comprising a feed tube for feeding a liquid into said channel of said flow-retaining head, for feeding a liquid suitable for preventing a solid from forming within said channel of said flow-retaining head.

6. A device according to claim 1, wherein said flow-retaining head comprises an elongated flow-retaining element that is adapted to be inserted into said tubular extension, said elongated flow-retaining element having a minimum cross section that is closer to a front end of said elongated flow-retaining element, and a maximum cross section that is closer to a rear end of said elongated flow-retaining element opposite to said minimum cross section, and cross sections whose area increases intermediate between said minimum cross section and said maximum cross section.

7. A device according to claim 6, wherein said elongated flow-retaining element has a frusto-conical shape.

8. A device according to claim 1, wherein said flow-retaining head has a plastically deformable sealing assembly, wherein a material is arranged on an outer surface of said flow-retaining head, whose hardness is lower with respect to the material of which said tubular extension is made at said outlet mouth, such that said plastically deformable sealing assembly is adapted to slidingly engage on said outlet mouth buckling and creating a seal by plastic deformation.

9. A device according to claim 8, wherein said plastically deformable sealing assembly comprises a layer that is made of said lower hardness metal material, said layer deposited about a removable element of said flow-retaining head.

10. A device according to claim 1, wherein said flow-retaining head has an elastically deformable sealing assembly wherein a material is arranged on an outer surface of said flow-retaining head, which is more deformable with respect to the material of which said tubular extension is made at said outlet mouth, such that said elastically deformable sealing assembly is adapted to elastically buckle creating a seal at a contour portion of said outlet mouth, in a final phase of said sliding approaching step.

11. A device according to claim 1, wherein said fastening mechanism comprises a plurality of teeth that are arranged along respective radial directions towards said axis, said teeth slidable along said respective radial directions within respective housings that are integral to said support, said teeth having respective inner ends that are adapted to engage with said tubular extension.

12. A device according to claim 11, wherein said teeth are adapted to engage with a protrusion of said tubular extension according to an engagement mode selected from the group consisting of:

an undercut engagement;

a clamp engagement, wherein said teeth are adapted to engage with a flange proximate to said outlet mouth.

13. A device according to claim 11, comprising a hydraulic actuator of said teeth, wherein said hydraulic actuator comprises, for one of said teeth, an hydraulic cylinder-piston unit.

14. A device according to claim 11, wherein each of said teeth has an actuator arranged to be operated by a ROV-type remotely operated vehicle that is suitable for underwater operation, in particular, said actuator arranged at external ends of said teeth.

15. A device according to claim 1, wherein said actuator comprises at least one hydraulic actuator unit comprising:

a actuation chamber, an actuation piston slidably arranged within said actuation chamber, and an actuator for applying an actuation force and for creating a sliding movement of said actuation piston within said actuation chamber between:

a rearward position and an extended position, at which a portion of said actuation piston extends outside of one end of said actuation chamber, which is longer than at said rearward position, said actuation chamber and said actuation piston integral to said flow-retaining head and to said support, or vice-versa such that, by operating said actuator, and by bringing said hydraulic actuator unit from said rearward position to said extended position, or vice-versa, said flow-retaining head performs said sliding approach towards said fastening mechanism thus approaching said outlet mouth.

16. A device according to claim 15, wherein said actuator comprises a control circuit that is hydraulically connected with a source of an actuation fluid and with said actuation chamber for transferring said actuation fluid from said source into said actuation chamber and for creating a sliding movement of said actuation piston within said actuation chamber, wherein said source of said actuation fluid has a pump in common with an actuation circuit of an auxiliary device, or of a device associated with said well.

17. A device according to claim 16, wherein said control circuit is adapted to transfer an actuation mud into said actuation chamber.

18. A device according to claim 16, comprising:

a compensation container;

a compensation element movably arranged within said compensation container, said compensation element defining within said compensation container a primary room and a secondary room, wherein said primary room is hydraulically connected with said source of an actuation fluid, wherein said secondary room is hydraulically connected with said actuation chamber.

19. A device according to claim 15, wherein said hydraulic actuator unit comprises furthermore:

a balancing chamber, a balancing piston integral to said actuation piston and slidably arranged within said balancing chamber, and a balancing circuit for applying a balancing force to said balancing piston responsive to an internal pressure of said tubular extension of said well, said balancing force having the same direction as said sliding approach, in order to limit said actuation force that acts on said actuation piston.

20. A device according to claim 19, wherein said balancing circuit comprises:

a compensation container;

a compensation element that is movably arranged within said compensation container, said compensation element defining within said compensation container a primary room and a secondary room, wherein said primary room is hydraulically connected with said tubular extension, wherein said secondary room is hydraulically connected with said balancing chamber.

21. A device according to claim 20, wherein said primary room is hydraulically connected with said tubular extension through said channel, in particular through said upper passage port.

22. A device according to claim 15, wherein said hydraulic actuator unit is a double-acting actuator unit.

23. A device according to claim 15, wherein said hydraulic actuator unit comprises a plugging fluid inlet duct adapted to operate at first said hydraulic actuator unit and to cause the sliding movement of said flow-retaining head with respect to said support along said slide axis from said maneuver position to said retaining position, and a shut-off valve is provided which is adapted to connect said duct with said channel so that said plugging fluid floods and pressurizes said well starting from said outlet mouth.

24. A device according to claim 1, comprising a lock mechanism for locking said flow-retaining head at said retaining position such that, by releasing said actuator, said flow-retaining head remains at said retaining position, thus preventing said pressurized fluid from flowing out of said tubular extension.

25. A device according to claim 24, wherein said actuation chamber and said actuation piston are arranged coaxially to the slide axis and are respectively integral to said support and to said flow-retaining head, and said lock mechanism comprises at least one longitudinal guide element integral to said support and a movable element integral to said flow-retaining head, said at least one longitudinal guide element and said movable element slidingly engaging each other, said at least one longitudinal guide element and said movable element adapted to be blocked with respect to each other, such that, by blocking said movable element with respect to the at least one longitudinal guide element after bringing said flow-retaining head to said retaining position, said actuator can be removed by cutting said at least one longitudinal guide element.

26. A device according to claim 1, wherein said actuator comprises at least one electric actuation unit.

27. A device according to claim 26, wherein said actuator comprises a worm screw adapted to be pivotally operated by the electric actuation unit, and said flow-retaining head comprises a nut screw, wherein said worm screw engages said nut screw, in order to provide said sliding movement of said flow-retaining head.

28. An underwater flow retaining method for retaining and blocking the outflow of a pressurized fluid from an outlet mouth of a tubular extension of an underwater well, comprising:

providing a flow-retaining head that is arranged to engage with said outlet mouth and to avoid the outlet of said pressurized fluid from said tubular extension, said flow-retaining head having a lower portion that faces said outlet mouth and an upper portion opposite to said lower portion;

providing a support of said flow-retaining head;

fastening said support to said tubular extension;

performing a sliding movement of said flow-retaining head with respect to said support along a slide axis of said support towards said fastening means when said support is fixed to said tubular extension by said fastening means, between:

a maneuver position, in which said flow-retaining head is at a predetermined distance from said outlet mouth and said fastening means can be fixed to said tubular extension, and a retaining position, in which said flow-retaining head engages said outlet mouth, said distance of the flow-retaining head in the maneuver position such that the support is fixed to the tubular extension by said fastening means while the flow-retaining head is still at a position where it is unaffected by the outflow of the pressurized fluid;

providing a channel that extends within said flow-retaining head between a lower passage port that is made at said lower portion and an upper passage port that is made at said upper portion;

wherein a step of feeding a plugging fluid is carried out through a feed duct that has a first end that is hydraulically connected with said upper passage port of said channel of said flow-retaining head, and a second end of said feed duct that is equipped with a fastening means for a duct or for a feed means of a plugging fluid, said plugging fluid fed into said tubular extension of the well through said lower passage port to plug said tubular extension by hardening of said plugging fluid.

29. A method according to claim 28, wherein said step of feeding a plugging fluid is carried out through a feed duct that has a first end that is hydraulically connected with said upper passage port of said channel of said flow-retaining head, and a second end of said feed duct that is equipped with a fastening means for a duct or for a feed means a fluid.

30. A method according to claim 29, wherein said plugging fluid is a mud, that is adapted to plug said well starting from said outlet mouth.

31. A method according to claim 29, wherein a step is provided of injecting said plugging fluid in order to cause, at first, the sliding movement of said flow-retaining head with respect to said support along said slide axis from said maneuver position to said retaining position, and then is also provided a step of opening a shut-off valve such that said plugging fluid flood said well starting from said outlet mouth at a determined pressure.

32. A method according to claim 28, wherein a discharge step is provided through a discharge channel that extends within said flow-retaining head between a lower discharge port that is made at said lower portion and an upper discharge port that is made at said upper portion.

* * * * *